US008322465B2

(12) United States Patent
Mirchandani

(10) Patent No.: US 8,322,465 B2
(45) Date of Patent: Dec. 4, 2012

(54) EARTH-BORING BIT PARTS INCLUDING HYBRID CEMENTED CARBIDES AND METHODS OF MAKING THE SAME

(75) Inventor: Prakash K. Mirchandani, Houston, TX (US)

(73) Assignee: TDY Industries, LLC, Pittsburgh, PA (US)

( * ) Notice: Subject to any disclaimer, the term of this patent is extended or adjusted under 35 U.S.C. 154(b) by 27 days.

(21) Appl. No.: 12/196,951

(22) Filed: Aug. 22, 2008

(65) Prior Publication Data

US 2010/0044115 A1 Feb. 25, 2010

(51) Int. Cl.
*E21B 10/08* (2006.01)

(52) U.S. Cl. ..... 175/374; 175/425; 175/432

(58) Field of Classification Search ..... 175/426, 175/425, 374, 432; 419/14; 75/312
See application file for complete search history.

(56) References Cited

U.S. PATENT DOCUMENTS

| | | | |
|---|---|---|---|
| 1,509,438 | A | 9/1924 | Miller |
| 1,530,293 | A | 3/1925 | Breitenstein |
| 1,808,138 | A | 6/1931 | Hogg et al. |
| 1,811,802 | A | 6/1931 | Newman |
| 1,912,298 | A | 5/1933 | Newman |
| 2,054,028 | A | 9/1936 | Benninghoff |
| 2,093,507 | A | 9/1937 | Bartek |
| 2,093,742 | A | 9/1937 | Staples |
| 2,093,986 | A | 9/1937 | Staples |
| 2,246,237 | A | 6/1941 | Benninghoff |
| 2,283,280 | A | 5/1942 | Nell |
| 2,299,207 | A | 10/1942 | Bevillard |
| 2,422,994 | A | 6/1947 | Taylor |
| 2,819,958 | A | 1/1958 | Abkowitz et al. |
| 2,819,959 | A | 1/1958 | Abkowitz et al. |
| 2,906,654 | A | 9/1959 | Abkowitz |
| 2,954,570 | A | 10/1960 | Couch |
| 3,041,641 | A | 7/1962 | Hradek et al. |
| 3,093,850 | A | 6/1963 | Kelso |
| 3,368,881 | A | 2/1968 | Abkowitz et al. |
| 3,471,921 | A | 10/1969 | Feenstra |
| 3,490,901 | A | 1/1970 | Hachisuka et al. |
| 3,581,835 | A | 6/1971 | Stebley |
| 3,629,887 | A | 12/1971 | Urbanic |
| 3,660,050 | A | 5/1972 | Iler et al. |
| 3,757,879 | A | 9/1973 | Wilder et al. |
| 3,776,655 | A | 12/1973 | Urbanic |
| 3,782,848 | A | 1/1974 | Pfeifer |

(Continued)

FOREIGN PATENT DOCUMENTS

| | | |
|---|---|---|
| AU | 695583 | 2/1998 |

(Continued)

OTHER PUBLICATIONS

US 4966627, Oct. 30, 1990, Keshavan et al., (withdrawn).

(Continued)

*Primary Examiner* — Cathleen Hutchins
(74) *Attorney, Agent, or Firm* — K&L Gates LLP; Patrick J. Viccaro; John E. Grosselin, III

(57) ABSTRACT

An earth-boring bit part such as, for example, a bit body, roller cone, or mud nozzle includes a hybrid cemented carbide composite. The hybrid cemented carbide includes a cemented carbide dispersed phase, and a cemented carbide continuous phase. A method of manufacture also is disclosed.

32 Claims, 7 Drawing Sheets

U.S. PATENT DOCUMENTS

| | | | | |
|---|---|---|---|---|
| 3,806,270 | A | | 4/1974 | Tanner et al. |
| 3,812,548 | A | | 5/1974 | Theuerkaue |
| RE28,645 | E | | 12/1975 | Aoki et al. |
| 3,942,954 | A | | 3/1976 | Frehn |
| 3,987,859 | A | | 10/1976 | Lichte |
| 4,009,027 | A | | 2/1977 | Naidich et al. |
| 4,017,480 | A | | 4/1977 | Baum |
| 4,047,828 | A | | 9/1977 | Makely |
| 4,094,709 | A | | 6/1978 | Rozmus |
| 4,097,180 | A | | 6/1978 | Kwieraga |
| 4,097,275 | A | | 6/1978 | Horvath |
| 4,106,382 | A | | 8/1978 | Salje et al. |
| 4,126,652 | A | | 11/1978 | Oohara et al. |
| 4,128,136 | A | | 12/1978 | Generoux |
| 4,170,499 | A | | 10/1979 | Thomas et al. |
| 4,198,233 | A | | 4/1980 | Frehn |
| 4,221,270 | A | | 9/1980 | Vezirian |
| 4,229,638 | A | | 10/1980 | Lichte |
| 4,233,720 | A | | 11/1980 | Rozmus |
| 4,255,165 | A | | 3/1981 | Dennis et al. |
| 4,270,952 | A | | 6/1981 | Kobayashi |
| 4,277,106 | A | | 7/1981 | Sahley |
| 4,306,139 | A | | 12/1981 | Shinozaki et al. |
| 4,311,490 | A | | 1/1982 | Bovenkerk et al. |
| 4,325,994 | A | | 4/1982 | Kitashima et al. |
| 4,327,156 | A | | 4/1982 | Dillon et al. |
| 4,340,327 | A | | 7/1982 | Martins |
| 4,341,557 | A | | 7/1982 | Lizenby |
| 4,376,793 | A | | 3/1983 | Jackson |
| 4,389,952 | A | | 6/1983 | Dreier et al. |
| 4,396,321 | A | | 8/1983 | Holmes |
| 4,398,952 | A | | 8/1983 | Drake |
| 4,478,297 | A | | 10/1984 | Radtke |
| 4,499,048 | A | | 2/1985 | Hanejko |
| 4,499,795 | A | | 2/1985 | Radtke |
| 4,526,748 | A | | 7/1985 | Rozmus |
| 4,547,104 | A | | 10/1985 | Holmes |
| 4,547,337 | A | | 10/1985 | Rozmus |
| 4,550,532 | A | | 11/1985 | Fletcher, Jr. et al. |
| 4,552,232 | A | | 11/1985 | Frear |
| 4,553,615 | A | * | 11/1985 | Grainger ..... 175/432 |
| 4,554,130 | A | | 11/1985 | Ecer |
| 4,562,990 | A | | 1/1986 | Rose |
| 4,574,011 | A | | 3/1986 | Bonjour et al. |
| 4,587,174 | A | | 5/1986 | Yoshimura et al. |
| 4,592,685 | A | | 6/1986 | Beere |
| 4,596,694 | A | | 6/1986 | Rozmus |
| 4,597,730 | A | | 7/1986 | Rozmus |
| 4,604,106 | A | | 8/1986 | Hall |
| 4,605,343 | A | | 8/1986 | Hibbs, Jr. et al. |
| 4,609,577 | A | | 9/1986 | Long |
| 4,630,693 | A | | 12/1986 | Goodfellow |
| 4,642,003 | A | | 2/1987 | Yoshimura |
| 4,649,086 | A | | 3/1987 | Johnson |
| 4,656,002 | A | | 4/1987 | Lizenby et al. |
| 4,662,461 | A | | 5/1987 | Garrett |
| 4,667,756 | A | | 5/1987 | King et al. |
| 4,686,080 | A | | 8/1987 | Hara et al. |
| 4,686,156 | A | | 8/1987 | Baldoni, II et al. |
| 4,694,919 | A | | 9/1987 | Barr |
| 4,708,542 | A | | 11/1987 | Emanuelli |
| 4,722,405 | A | | 2/1988 | Langford |
| 4,729,789 | A | | 3/1988 | Ide et al. |
| 4,734,339 | A | | 3/1988 | Schachner et al. |
| 4,743,515 | A | | 5/1988 | Fischer et al. |
| 4,744,943 | A | | 5/1988 | Timm |
| 4,749,053 | A | | 6/1988 | Hollingshead |
| 4,752,159 | A | | 6/1988 | Howlett |
| 4,752,164 | A | | 6/1988 | Leonard, Jr. |
| 4,809,903 | A | | 3/1989 | Eylon et al. |
| 4,838,366 | A | | 6/1989 | Jones |
| 4,861,350 | A | | 8/1989 | Phaal et al. |
| 4,871,377 | A | | 10/1989 | Frushour |
| 4,884,477 | A | | 12/1989 | Smith et al. |
| 4,889,017 | A | | 12/1989 | Fuller et al. |
| 4,899,838 | A | | 2/1990 | Sullivan et al. |
| 4,919,013 | A | | 4/1990 | Smith et al. |
| 4,923,512 | A | | 5/1990 | Timm et al. |
| 4,956,012 | A | | 9/1990 | Jacobs et al. |
| 4,968,348 | A | | 11/1990 | Abkowitz et al. |
| 4,991,670 | A | | 2/1991 | Fuller et al. |
| 5,000,273 | A | | 3/1991 | Horton et al. |
| 5,030,598 | A | | 7/1991 | Hsieh |
| 5,032,352 | A | | 7/1991 | Meeks et al. |
| 5,041,261 | A | | 8/1991 | Buljan et al. |
| 5,049,450 | A | | 9/1991 | Dorfman et al. |
| RE33,753 | E | | 11/1991 | Vacchiano et al. |
| 5,067,860 | A | | 11/1991 | Kobayashi et al. |
| 5,090,491 | A | | 2/1992 | Tibbitts et al. |
| 5,092,412 | A | | 3/1992 | Walk |
| 5,098,232 | A | | 3/1992 | Benson |
| 5,110,687 | A | | 5/1992 | Abe et al. |
| 5,112,162 | A | | 5/1992 | Hartford et al. |
| 5,112,168 | A | | 5/1992 | Glimpel |
| 5,127,776 | A | | 7/1992 | Glimpel |
| 5,161,898 | A | | 11/1992 | Drake |
| 5,174,700 | A | | 12/1992 | Sgarbi et al. |
| 5,179,772 | A | | 1/1993 | Braun et al. |
| 5,186,739 | A | | 2/1993 | Isobe et al. |
| 5,203,513 | A | | 4/1993 | Keller et al. |
| 5,203,932 | A | | 4/1993 | Kato et al. |
| 5,232,522 | A | | 8/1993 | Doktycz et al. |
| 5,266,415 | A | | 11/1993 | Newkirk et al. |
| 5,273,380 | A | | 12/1993 | Musacchia |
| 5,281,260 | A | | 1/1994 | Kumar et al. |
| 5,286,685 | A | | 2/1994 | Schoennahl et al. |
| 5,305,840 | A | | 4/1994 | Liang et al. |
| 5,311,958 | A | | 5/1994 | Isbell et al. |
| 5,326,196 | A | | 7/1994 | Noll |
| 5,333,520 | A | | 8/1994 | Fischer et al. |
| 5,348,806 | A | | 9/1994 | Kojo et al. |
| 5,354,155 | A | | 10/1994 | Adams |
| 5,359,772 | A | | 11/1994 | Carlsson et al. |
| 5,373,907 | A | | 12/1994 | Weaver |
| 5,376,329 | A | | 12/1994 | Morgan et al. |
| 5,423,899 | A | | 6/1995 | Krall et al. |
| 5,433,280 | A | | 7/1995 | Smith |
| 5,438,858 | A | | 8/1995 | Friedrichs |
| 5,443,337 | A | | 8/1995 | Katayama |
| 5,452,771 | A | | 9/1995 | Blackman et al. |
| 5,467,669 | A | | 11/1995 | Stroud |
| 5,479,997 | A | | 1/1996 | Scott et al. |
| 5,480,272 | A | | 1/1996 | Jorgensen et al. |
| 5,482,670 | A | | 1/1996 | Hong |
| 5,484,468 | A | | 1/1996 | Östlund et al. |
| 5,487,626 | A | | 1/1996 | Von Holst et al. |
| 5,496,137 | A | | 3/1996 | Ochayon et al. |
| 5,505,748 | A | | 4/1996 | Tank et al. |
| 5,506,055 | A | | 4/1996 | Dorfman et al. |
| 5,518,077 | A | | 5/1996 | Blackman et al. |
| 5,525,134 | A | | 6/1996 | Mehrotra et al. |
| 5,541,006 | A | | 7/1996 | Conley |
| 5,543,235 | A | | 8/1996 | Mirchandani et al. |
| 5,544,550 | A | | 8/1996 | Smith |
| 5,560,440 | A | | 10/1996 | Tibbitts |
| 5,570,978 | A | | 11/1996 | Rees et al. |
| 5,580,666 | A | | 12/1996 | Dubensky et al. |
| 5,586,612 | A | | 12/1996 | Isbell et al. |
| 5,590,729 | A | | 1/1997 | Cooley et al. |
| 5,593,474 | A | | 1/1997 | Keshavan et al. |
| 5,601,857 | A | | 2/1997 | Friedrichs |
| 5,603,075 | A | | 2/1997 | Stoll et al. |
| 5,609,447 | A | | 3/1997 | Britzke et al. |
| 5,611,251 | A | | 3/1997 | Katayama |
| 5,612,264 | A | | 3/1997 | Nilsson et al. |
| 5,628,837 | A | | 5/1997 | Britzke et al. |
| RE35,538 | E | | 6/1997 | Akesson et al. |
| 5,635,247 | A | | 6/1997 | Ruppi |
| 5,641,251 | A | | 6/1997 | Leins et al. |
| 5,641,921 | A | | 6/1997 | Dennis et al. |
| 5,662,183 | A | | 9/1997 | Fang |
| 5,665,431 | A | | 9/1997 | Narasimhan |
| 5,666,864 | A | | 9/1997 | Tibbitts |
| 5,677,042 | A | | 10/1997 | Massa et al. |
| 5,679,445 | A | | 10/1997 | Massa et al. |
| 5,686,119 | A | | 11/1997 | McNaughton, Jr. |
| 5,697,042 | A | | 12/1997 | Massa et al. |

5,697,046 A 12/1997 Conley
5,697,462 A 12/1997 Grimes et al.
5,718,948 A 2/1998 Ederyd et al.
5,732,783 A 3/1998 Truax et al.
5,733,649 A 3/1998 Kelley et al.
5,733,664 A 3/1998 Kelley et al.
5,750,247 A 5/1998 Bryant et al.
5,753,160 A 5/1998 Takeuchi et al.
5,755,033 A 5/1998 Günter et al.
5,762,843 A 6/1998 Massa et al.
5,765,095 A 6/1998 Flak et al.
5,776,593 A 7/1998 Massa et al.
5,778,301 A 7/1998 Hong
5,789,686 A 8/1998 Massa et al.
5,792,403 A 8/1998 Massa et al.
5,806,934 A 9/1998 Massa et al.
5,830,256 A 11/1998 Northrop et al.
5,851,094 A 12/1998 Stand et al.
5,856,626 A 1/1999 Fischer et al.
5,863,640 A 1/1999 Ljungberg et al.
5,865,571 A 2/1999 Tankala et al.
5,873,684 A 2/1999 Flolo
5,880,382 A * 3/1999 Fang et al. ..... 75/236
5,890,852 A 4/1999 Gress
5,897,830 A 4/1999 Abkowitz et al.
5,947,660 A 9/1999 Karlsson et al.
5,957,006 A 9/1999 Smith
5,963,775 A 10/1999 Fang
5,964,555 A 10/1999 Strand
5,967,249 A 10/1999 Butcher
5,971,670 A 10/1999 Pantzar et al.
5,976,707 A 11/1999 Grab et al.
5,988,953 A 11/1999 Berglund et al.
6,007,909 A 12/1999 Rolander et al.
6,022,175 A 2/2000 Heinrich et al.
6,029,544 A 2/2000 Katayama
6,051,171 A 4/2000 Takeuchi et al.
6,063,333 A 5/2000 Dennis
6,068,070 A 5/2000 Scott
6,073,518 A 6/2000 Chow et al.
6,086,003 A 7/2000 Günter et al.
6,086,980 A 7/2000 Foster et al.
6,089,123 A 7/2000 Chow et al.
6,148,936 A 11/2000 Evans et al.
6,200,514 B1 3/2001 Meister
6,209,420 B1 4/2001 Butcher et al.
6,214,134 B1 4/2001 Eylon et al.
6,214,247 B1 4/2001 Leverenz et al.
6,214,287 B1 4/2001 Waldenström
6,217,992 B1 4/2001 Grab
6,220,117 B1 4/2001 Butcher
6,227,188 B1 5/2001 Tankala et al.
6,228,139 B1 5/2001 Oskarrson
6,241,036 B1 6/2001 Lovato et al.
6,248,277 B1 6/2001 Friedrichs
6,254,658 B1 7/2001 Taniuchi et al.
6,287,360 B1 9/2001 Kembaiyan et al.
6,290,438 B1 9/2001 Papajewski
6,293,986 B1 9/2001 Rödiger et al.
6,299,658 B1 10/2001 Moriguchi et al.
6,353,771 B1 3/2002 Southland
6,372,346 B1 4/2002 Toth
6,374,932 B1 4/2002 Brady
6,375,706 B2 4/2002 Kembaiyan et al.
6,386,954 B2 5/2002 Sawabe et al.
6,395,108 B2 5/2002 Eberle et al.
6,425,716 B1 7/2002 Cook
6,450,739 B1 9/2002 Puide et al.
6,453,899 B1 9/2002 Tselesin
6,454,025 B1 9/2002 Runquist et al.
6,454,028 B1 9/2002 Evans
6,454,030 B1 9/2002 Findley et al.
6,458,471 B2 10/2002 Lovato et al.
6,461,401 B1 10/2002 Kembaiyan et al.
6,474,425 B1 11/2002 Truax et al.
6,499,917 B1 12/2002 Parker et al.
6,499,920 B2 12/2002 Sawabe
6,500,226 B1 12/2002 Dennis
6,502,623 B1 1/2003 Schmitt
6,511,265 B1 1/2003 Mirchandani et al.
6,544,308 B2 4/2003 Griffin et al.
6,554,548 B1 4/2003 Grab et al.
6,562,462 B2 5/2003 Griffin et al.
6,576,182 B1 6/2003 Ravagni et al.
6,585,064 B2 7/2003 Griffin et al.
6,589,640 B2 7/2003 Griffin et al.
6,599,467 B1 7/2003 Yamaguchi et al.
6,607,693 B1 8/2003 Saito et al.
6,620,375 B1 9/2003 Tank et al.
6,638,609 B2 10/2003 Nordgren et al.
6,655,481 B2 12/2003 Findley et al.
6,676,863 B2 1/2004 Christiaens et al.
6,685,880 B2 2/2004 Engström et al.
6,688,988 B2 2/2004 McClure
6,695,551 B2 2/2004 Silver
6,706,327 B2 3/2004 Blomstedt et al.
6,719,074 B2 4/2004 Tsuda et al.
6,723,389 B2 4/2004 Kobayashi et al.
6,737,178 B2 5/2004 Ota et al.
6,742,608 B2 6/2004 Murdoch
6,742,611 B1 6/2004 Illerhaus et al.
6,756,009 B2 6/2004 Sim et al.
6,764,555 B2 7/2004 Hiramatsu et al.
6,766,870 B2 7/2004 Overstreet
6,808,821 B2 10/2004 Fujita et al.
6,844,085 B2 1/2005 Takayama et al.
6,848,521 B2 2/2005 Lockstedt et al.
6,849,231 B2 2/2005 Kojima et al.
6,884,496 B2 4/2005 Westphal et al.
6,899,495 B2 5/2005 Hansson et al.
6,918,942 B2 7/2005 Hatta et al.
6,948,890 B2 9/2005 Svensson et al.
6,949,148 B2 9/2005 Sugiyama et al.
6,955,233 B2 10/2005 Crowe et al.
6,958,099 B2 10/2005 Nakamura et al.
7,014,719 B2 3/2006 Suzuki et al.
7,014,720 B2 3/2006 Iseda
7,044,243 B2 5/2006 Kembaiyan et al.
7,048,081 B2 5/2006 Smith et al.
7,070,666 B2 7/2006 Druschitz et al.
7,090,731 B2 8/2006 Kashima et al.
7,101,128 B2 9/2006 Hansson
7,101,446 B2 9/2006 Takeda et al.
7,112,143 B2 9/2006 Muller
7,128,773 B2 10/2006 Liang et al.
7,147,413 B2 12/2006 Henderer et al.
7,175,404 B2 2/2007 Kondo et al.
7,238,414 B2 7/2007 Benitsch et al.
7,244,519 B2 7/2007 Festeau et al.
7,250,069 B2 7/2007 Kembaiyan et al.
7,261,782 B2 8/2007 Hwang et al.
7,267,543 B2 9/2007 Freidhoff et al.
7,270,679 B2 9/2007 Istephanous et al.
7,381,283 B2 6/2008 Lee et al.
7,384,413 B2 6/2008 Gross et al.
7,384,443 B2 6/2008 Mirchandani et al.
7,410,610 B2 8/2008 Woodfield et al.
7,497,396 B2 3/2009 Splinter et al.
7,513,320 B2 4/2009 Mirchandani et al.
7,524,351 B2 4/2009 Hua et al.
7,575,620 B2 8/2009 Terry et al.
7,625,157 B2 12/2009 Prichard et al.
7,846,551 B2 12/2010 Fang et al.
7,954,569 B2 6/2011 Mirchandani et al.
8,025,112 B2 9/2011 Mirchandani et al.
2002/0004105 A1 1/2002 Kunze et al.
2003/0010409 A1 1/2003 Kunze et al.
2003/0041922 A1 3/2003 Hirose et al.
2003/0219605 A1 11/2003 Molian et al.
2004/0013558 A1 1/2004 Kondoh et al.
2004/0105730 A1 6/2004 Nakajima
2004/0129403 A1 7/2004 Liu et al.
2004/0228695 A1 11/2004 Clauson
2004/0234820 A1 11/2004 Majagi
2004/0245022 A1 12/2004 Izaguirre et al.
2004/0245024 A1 12/2004 Kembaiyan
2005/0008524 A1 1/2005 Testani
2005/0025928 A1 2/2005 Annanolli et al.

| | | | | |
|---|---|---|---|---|
| 2005/0084407 | A1 | 4/2005 | Myrick | |
| 2005/0103404 | A1 | 5/2005 | Hsieh et al. | |
| 2005/0117984 | A1 | 6/2005 | Eason et al. | |
| 2005/0126334 | A1* | 6/2005 | Mirchandani | 75/240 |
| 2005/0194073 | A1 | 9/2005 | Hamano et al. | |
| 2005/0211475 | A1 | 9/2005 | Mirchandani et al. | |
| 2005/0268746 | A1 | 12/2005 | Abkowitz et al. | |
| 2006/0016521 | A1 | 1/2006 | Hanusiak et al. | |
| 2006/0032677 | A1 | 2/2006 | Azar et al. | |
| 2006/0043648 | A1 | 3/2006 | Takeuchi et al. | |
| 2006/0060392 | A1 | 3/2006 | Eyre | |
| 2006/0131081 | A1* | 6/2006 | Mirchandani et al. | 175/426 |
| 2006/0286410 | A1 | 12/2006 | Ahlgren et al. | |
| 2007/0042217 | A1 | 2/2007 | Fang et al. | |
| 2007/0082229 | A1 | 4/2007 | Mirchandani et al. | |
| 2007/0102198 | A1 | 5/2007 | Oxford et al. | |
| 2007/0102199 | A1 | 5/2007 | Smith et al. | |
| 2007/0102200 | A1 | 5/2007 | Choe et al. | |
| 2007/0102202 | A1 | 5/2007 | Choe et al. | |
| 2007/0126334 | A1 | 6/2007 | Nakamura et al. | |
| 2007/0163679 | A1 | 7/2007 | Fujisawa et al. | |
| 2007/0193782 | A1 | 8/2007 | Fang et al. | |
| 2007/0251732 | A1 | 11/2007 | Mirchandani et al. | |
| 2008/0011519 | A1* | 1/2008 | Smith et al. | 175/374 |
| 2008/0101977 | A1 | 5/2008 | Eason et al. | |
| 2008/0145686 | A1 | 6/2008 | Michandani et al. | |
| 2008/0196318 | A1 | 8/2008 | Bost et al. | |
| 2008/0302576 | A1 | 12/2008 | Mirchandani et al. | |
| 2009/0041612 | A1 | 2/2009 | Fang et al. | |
| 2009/0136308 | A1 | 5/2009 | Newitt | |
| 2009/0180915 | A1 | 7/2009 | Mirchandani et al. | |
| 2009/0293672 | A1 | 12/2009 | Mirchandani et al. | |
| 2010/0044114 | A1 | 2/2010 | Mirchandani et al. | |
| 2010/0290849 | A1 | 11/2010 | Mirchandani et al. | |
| 2010/0303566 | A1 | 12/2010 | Fang et al. | |
| 2011/0011965 | A1 | 1/2011 | Mirchandani et al. | |
| 2011/0265623 | A1 | 11/2011 | Mirchandani et al. | |
| 2011/0290566 | A1 | 12/2011 | Mirchandani et al. | |

FOREIGN PATENT DOCUMENTS

| | | | |
|---|---|---|---|
| CA | 2212197 | C | 10/2000 |
| EP | 0157625 | A2 | 10/1985 |
| EP | 0264674 | A2 | 4/1988 |
| EP | 0453428 | A1 | 10/1991 |
| EP | 0641620 | B1 | 2/1998 |
| EP | 0995876 | A2 | 4/2000 |
| EP | 1065021 | A1 | 1/2001 |
| EP | 1066901 | A2 | 1/2001 |
| EP | 1077783 | B1 | 2/2001 |
| EP | 1106706 | A1 | 6/2001 |
| EP | 0759480 | B1 | 1/2002 |
| EP | 1244531 | B1 | 10/2004 |
| EP | 1686193 | A2 | 8/2006 |
| EP | 1198609 | B2 | 10/2007 |
| FR | 2627541 | A2 | 8/1989 |
| GB | 622041 | | 4/1949 |
| GB | 945227 | | 12/1963 |
| GB | 1082568 | | 9/1967 |
| GB | 1309634 | | 3/1973 |
| GB | 1420906 | | 1/1976 |
| GB | 1491044 | | 11/1977 |
| GB | 2158744 | A | 11/1985 |
| GB | 2218931 | A | 11/1989 |
| GB | 2324752 | A | 11/1998 |
| GB | 2352727 | A | 2/2001 |
| GB | 2385350 | A | 8/2003 |
| GB | 2393449 | A | 3/2004 |
| GB | 2397832 | A | 8/2004 |
| GB | 2435476 | A | 8/2007 |
| JP | 51-124876 | A | 10/1976 |
| JP | 59-175912 | A | 10/1984 |
| JP | 60-172403 | A | 9/1985 |
| JP | 61-243103 | A | 10/1986 |
| JP | 61057123 | B | 12/1986 |
| JP | 62-063005 | A | 3/1987 |
| JP | 2-269515 | A | 11/1990 |
| JP | 5-50314 | A | 3/1993 |
| JP | H03-119090 | U | 6/1995 |
| JP | 8-120308 | A | 5/1996 |
| JP | H8-209284 | | 8/1996 |
| JP | 10219385 | A | 8/1998 |
| JP | 11-300516 | A | 11/1999 |
| JP | 2002-097885 | A | 4/2002 |
| JP | 2002-166326 | A | 6/2002 |
| JP | 02254144 | A | 9/2002 |
| JP | 2002-317596 | A | 10/2002 |
| JP | 2003-306739 | A | 10/2003 |
| JP | 2004-181604 | | 7/2004 |
| JP | 2004-190034 | A | 7/2004 |
| JP | 2005-111581 | A | 4/2005 |
| RU | 2135328 | C1 | 8/1999 |
| SU | 1292917 | A1 | 2/1987 |
| SU | 1350322 | | 11/1987 |
| WO | WO 92/05009 | A1 | 4/1992 |
| WO | WO 92/22390 | A1 | 12/1992 |
| WO | WO 98/28455 | A1 | 7/1998 |
| WO | WO 99/13121 | A1 | 3/1999 |
| WO | WO 00/43628 | A2 | 7/2000 |
| WO | WO 00/52217 | A1 | 9/2000 |
| WO | WO 00/73532 | A1 | 12/2000 |
| WO | WO 01/43899 | A1 | 6/2001 |
| WO | WO 03/010350 | A1 | 2/2003 |
| WO | WO 03/011508 | A2 | 2/2003 |
| WO | WO 03/049889 | A2 | 6/2003 |
| WO | WO 2004/053197 | A2 | 6/2004 |
| WO | WO 2005/045082 | A1 | 5/2005 |
| WO | WO 2005/054530 | A1 | 6/2005 |
| WO | WO 2005/061746 | A1 | 7/2005 |
| WO | WO 2005/106183 | A1 | 11/2005 |
| WO | WO 2006/071192 | A1 | 7/2006 |
| WO | WO 2006/104004 | A1 | 10/2006 |
| WO | WO 2007/001870 | A2 | 1/2007 |
| WO | WO 2007/022336 | A2 | 2/2007 |
| WO | WO 2007/030707 | A1 | 3/2007 |
| WO | WO 2007/044791 | A1 | 4/2007 |
| WO | WO 2007/127680 | A1 | 11/2007 |
| WO | WO 2008/098636 | A1 | 8/2008 |
| WO | WO 2008/115703 | A1 | 9/2008 |
| WO | WO 2011/008439 | A2 | 1/2011 |

OTHER PUBLICATIONS

Advisory Action mailed Jun. 29, 2009 in U.S. Appl. No. 10/903,198.
ASM Materials Engineering Dictionary, J. R. Davis, Ed., ASM International, Fifth printing (Jan. 2006), p. 98.
Coyle, T.W. and A. Bahrami, "Structure and Adhesion of Ni and Ni—WC Plasma Spray Coatings," Thermal Spray, Surface Engineering via Applied Research, Proceedings of the 1st International Thermal Spray Conference, May 8-11, 2000, Montreal, Quebec, Canada, pp. 251-254.
Deng, X. et al., "Mechanical Properties of a Hybrid Cemented Carbide Composite," International Journal of Refractory Metals and Hard Materials, Elsevier Science Ltd., vol. 19, 2001, pp. 547-552.
Gurland, J. *Quantitative Microscopy*, R.T. DeHoff and F.N. Rhines, eds., McGraw-Hill Book Company, New York, 1968, pp. 279-290.
Gurland, Joseph, "Application of Quantitative Microscopy to Cemented Carbides," Practical Applications of Quantitative Matellography, ASTM Special Technical Publication 839, ASTM 1984, pp. 65-84.
Hayden, Matthew and Lyndon Scott Stephens, "Experimental Results for a Heat-Sink Mechanical Seal," Tribology Transactions, 48, 2005, pp. 352-361.
Metals Handbook, vol. 16 Machining, "Tapping" (ASM International 1989), pp. 255-267.
Notice of Allowance issued on Jan. 27, 2009 in U.S. Appl. No. 11/116,752.
Notice of Allowance mailed Oct. 21, 2002 in U.S. Appl. No. 09/460,540.
Notice of Allowance issued on Nov. 13, 2008 in U.S. Appl. No. 11/206,368.
Notice of Allowance issued on Nov. 26, 2008 in U.S. Appl. No. 11/013,842.
Notice of Allowance issued on Nov. 30, 2009 in U.S. Appl. No. 11/206,368.
Notice of Allowance issued on Jan. 26, 2010 in U.S. Appl. No. 11/116,752.

Office Action (Advisory Action) mailed Mar. 15, 2002 in U.S. Appl. No. 09/460,540.
Office Action (final) mailed Dec. 1, 2001 in U.S. Appl. No. 09/460,540.
Office Action (non-final) mailed Jun. 1, 2001 in U.S. Appl. No. 09/460,540.
Office Action (non-final) mailed Jun. 18, 2002 in U.S. Appl. No. 09/460,540.
Office Action issued on Aug. 12, 2008 in U.S. Appl. No. 11/116,752.
Office Action issued on Jul. 9, 2009 in U.S. Appl. No. 11/116,752.
Office Action issued on Aug. 31, 2007 in U.S. Appl. No. 11/206,368.
Office Action issued on Feb. 28, 2008 in U.S. Appl. No. 11/206,368.
Office Action issued on Jan. 15, 2008 in U.S. Appl. No. 11/116,752.
Office Action issued on Jan. 16, 2007 in U.S. Appl. No. 11/013,842.
Office Action issued on Jan. 24, 2008 in U.S. Appl. No. 10/848,437.
Office Action issued on Jul. 16, 2008 in U.S. Appl. No. 11/013,842.
Office Action issued on Jul. 30, 2007 in U.S. Appl. No. 11/013,842.
Office Action mailed Apr. 30, 2009 in U.S. Appl. No. 11/206,368.
Office Action mailed Oct. 31, 2008 in U.S. Appl. No. 10/903,198.
Office Action mailed Apr. 17, 2009 in U.S. Appl. No. 10/903,198.
Peterman, Walter, "Heat-Sink Compound Protects the Unprotected," Welding Design and Fabrication, Sep. 2003, pp. 20-22.
Pre-Appeal Brief Conference Decision issued on May 14, 2008 in U.S. Appl. No. 10/848,437.
Pre-Appeal Conference Decision issued on Jun. 19, 2008 in U.S. Appl. No. 11/206,368.
Restriction Requirement issued on Sep. 8, 2006 in U.S. Appl. No. 10/848,437.
Sriram, et al., "Effect of Cerium Addition on Microstructures of Carbon-Alloyed Iron Aluminides," Bull. Mater. Sci., vol. 28, No. 6, Oct. 2005, pp. 547-554.
Tracey et al., "Development of Tungsten Carbide-Cobalt-Ruthenium Cutting Tools for Machining Steels" Proceedings Annual Microprogramming Workshop, vol. 14, 1981, pp. 281-292.
Underwood, *Quantitative Stereology*, pp. 23-108 (1970).
U.S. Appl. No. 12/464,607, filed May 12, 2009.
U.S. Appl. No. 12/502,277, filed Jul. 14, 2009.
U.S. Appl. No. 12/616,300, filed Nov. 11, 2009.
Office Action mailed Mar. 12, 2009 in U.S. Appl. No. 11/585,408.
Office Action mailed Sep. 22, 2009 in U.S. Appl. No. 11/585,408.
Office Action mailed Sep. 7, 2010 in U.S. Appl. No. 11/585,408.
Office Action mailed Feb. 16, 2011 in U.S. Appl. No. 11/585,408.
Advisory Action mailed May 3, 2011 in U.S. Appl. No. 11/585,408.
Office Action mailed Aug. 17, 2011 in U.S. Appl. No. 11/585,408.
Restriction Requirement mailed Jul. 24, 2008 in U.S. Appl. No. 11/167,811.
Office Action mailed Oct. 21, 2008 in U.S. Appl. No. 11/167,811.
Final Office Action mailed Jun. 12, 2009 in U.S. Appl. No. 11/167,811.
Office Action mailed Aug. 28, 2009 in U.S. Appl. No. 11/167,811.
Office Action mailed Mar. 2, 2010 in U.S. Appl. No. 11/167,811.
Office Action mailed Aug. 19, 2010 in U.S. Appl. No. 11/167,811.
Advisory Action Before the Filing of an Appeal Brief mailed May 12, 2010 in U.S. Appl. No. 11/167,811.
Office Action mailed Feb. 3, 2011 in U.S. Appl. No. 11/167,811.
Advisory Action mailed May 11, 2011 in U.S. Appl. No. 11/167,811.
Office Action mailed Jul. 22, 2011 in U.S. Appl. No. 11/167,811.
Office Action mailed Mar. 19, 2009 in U.S. Appl. No. 11/737,993.
Office Action mailed Jun. 3, 2009 in U.S. Appl. No. 11/737,993.
Office Action mailed Dec. 9, 2009 in U.S. Appl. No. 11/737,993.
Office Action mailed Feb. 24, 2010 in U.S. Appl. No. 11/737,993.
Office Action mailed Jun. 29, 2010 in U.S. Appl. No. 11/737,993.
Advisory Action Before the Filing of an Appeal Brief mailed Sep. 9, 2010 in U.S. Appl. No. 11/737,993.
Pre-Brief Appeal Conference Decision mailed Nov. 22, 2010 in U.S. Appl. No. 11/737,993.
Office Action mailed Apr. 20, 2011 in U.S. Appl. No. 11/737,993.
Office Action mailed Aug. 3, 2011 in U.S. Appl. No. 11/737,993.
Office Action mailed Oct. 11, 2011 in U.S. Appl. No. 11/737,993.
Office Action rnalied Jan. 6, 2012 in U.S. Appl. No. 11/737,993.
Restriction Requirement mailed Sep. 17, 2010 in U.S. Appl. No. 12/397,597.
Office Action mailed Nov. 15, 2010 in U.S. Appl. No. 12/397,597.
Office Action mailed Jun. 7, 2011 in U.S. Appl. No. 12/397,597.
Advisory Action Before the Filing of an Appeal Brief mailed Aug. 31, 2011 in U.S. Appl. No. 12/397,597.
Office Action mailed Nov. 17, 2011 in U.S. Appl. No. 12/397,597.
Advisory Action mailed Jan. 26, 2012 in U.S. Appl. No. 12/397,597.
Office Action mailed May 3, 2010 in U.S. Appl. No. 11/924,273.
Office Action mailed Oct. 14, 2010 in U.S. Appl. No. 11/924,273.
Office Action mailed Feb. 2, 2011 in U.S. Appl. No. 11/924,273.
Interview Summary mailed Feb. 16, 2011 in U.S. Appl. No. 11/924,273.
Interview Summary mailed May 9, 2011 in U.S. Appl. No. 11/924,273.
Notice of Allowance mailed Jun. 24, 2011 in U.S. Appl. No. 11/924,273.
Office Action mailed Dec. 29, 2005 in U.S. Appl. No. 10/903,198
Office Action mailed Sep. 29, 2006 in U.S. Appl. No. 10/903,198.
Office Action mailed Mar. 27, 2007 in U.S. Appl. No. 10/903,198.
Office Action mailed Sep. 26, 2007 in U.S. Appl. No. 10/903,198.
Office Action mailed Jan. 16, 2008 in U.S. Appl. No. 10/903,198.
Advisory Action before mailing of Appeal Brief mailed Jun. 29, 2009 in U.S. Appl. No. 10/903,198.
Examiner's Answer mailed Aug. 17, 2010 in U.S. Appl. No. 10/903,198.
Office Action mailed Oct. 13, 2011 in U.S. Appl. No. 12/179,999.
Office Action mailed Sep. 2, 2011 in U.S. Appl. No. 12/850,003.
Notice of Allowance mailed Nov. 15, 2011 in U.S. Appl. No. 12/850,003.
Office Action mailed Aug. 29, 2011 in U.S. Appl. No. 12/476,738.
Office Action mailed Dec. 21, 2011 in U.S. Appl. No. 12/476,738.
Office Action mailed Nov. 14, 2011 in U.S. Appl. No. 12/502,277.
Office Action mailed Jan. 20, 2012 in U.S. Appl. No. 12/502,277.
Office Action mailed Oct. 31, 2011 in U.S. Appl. No. 13/207,478.
Office Action mailed Dec. 5, 2011 in U.S. Appl. No. 13/182,474.
Office Action mailed Oct. 13, 2006 in U.S. Appl. No. 10/922,750.
Notice of Allowance mailed May 21, 2007 for U.S. Appl. No. 10/922,750.
Supplemental Notice of Allowability mailed Jul. 3, 2007 for U.S. Appl. No. 10/922,750.
Office Action mailed May 14, 2009 in U.S. Appl. No. 11/687,343.
Office Action mailed Jan. 21, 2010 in U.S. Appl. No. 11/687,343.
Notice of Allowance mailed May 18, 2010 in U.S. Appl. No. 11/687,343.
Restriction Requirement mailed Aug. 4, 2010 in U.S. Appl. No. 12/196,815.
Office Action mailed Oct. 27, 2010 in U.S. Appl. No. 12/196,815.
Office Action mailed Nov. 17, 2010 in U.S. Appl. No. 12/196,815.
Notice of Allowance mailed Jan. 27, 2011 in U.S. Appl. No. 12/196,815.
Notice of Allowance mailed May 16, 2011 in U.S. Appl. No. 12/196,815.
Pre-Appeal Conference Decision mailed Jun. 19, 2008 in U.S. Appl. No. 11/206,368.
Metals Handbook, vol. 16 Machining, "Cemented Carbides" (ASM International 1989), pp. 71-89.
Shi et al., "Composite Ductility—The Role of Reinforcement and Matrix", TMS Meeting, Las Vegas, NV, Feb. 12-16, 1995, 10 pages.
Vander Vort, "Introduction to Quantitative Metallography", Tech Notes, vol. 1, Issue 5, published by Buehler, Ltd, 1997, 6 pages.
You Tube, "The Story Behind Kennametal's Beyond Blast", dated Sep. 14, 2010, http://www.youtube.com/watch?v=8_A-bYVwmU8 (3 pages) accessed on Oct. 14, 2010.
Kennametal press release on Jun. 10, 2010, http://news.thomasnet.com/companystory/Kennametal-Launches-Beyond-BLAST-TM-at-IMTS-2010-Booth-W-1522-833445 (2 pages) accessed on Oct. 14, 2010.
Pages from Kennametal site, https://www.kennametal.com/en-US/promotions/Beyond_Blast.jhtmi (7 pages) accessed on Oct. 14, 2010.
Childs et al., "Metal Machining", 2000, Elsevier, p. 111.
Firth Sterling grade chart, Allegheny Technologies, attached to Declaration of Prakash Mirchandani, Ph.D. as filed in U.S. Appl. No. 11/737,993 on Sep. 9, 2009.

Metals Handbook Desk Edition, definition of 'wear', 2nd Ed., J.R. Davis, Editor, ASM International 1998, p. 62.
McGraw-Hill Dictionary of Scientific and Technical Terms, 5th Edition, Sybil P. Parker, Editor in Chief, 1993, pp. 799, 800, 1933, and 2047.
ProKon Version 8.6, The Calculation Companion, Properties for W, Ti, Mo, Co, Ni and FE, Copyright 1997-1998, 6 pages.
TIBTECH Innovations, "Properties table of stainless steel, metals and other conductive materials", printed from http://www.tibtech.com/conductivity.php on Aug. 19, 2011, 1 page.
"Material: Tungsten Carbide (WC), bulk", MEMSnet, printed from http://www.memsnet.org/material/tungstencarbidewcbulk/ on Aug. 19, 2001, 1 page.
Williams, Wendell S., "The Thermal Conductivity of Metallic Ceramics", JOM, Jun. 1998, pp. 62-66.
Brookes, Kenneth J. A., "World Directory and Handbook of Hardmetals and Hard Materials", International Carbide Data, U.K. 1996, Sixth Edition, pp. D182-D184.
Thermal Conductivity of Metals, The Engineering ToolBox, printed from http://www.engineeringtoolbox.com/thermal-conductivity-metals-d_858.html on Oct. 27, 2011, 3 pages.
Shing et al., "The effect of ruthenium additions on hardness, toughness and grain size of WC—Co," Int. J. of Refractory Metals & Hard Materials, vol. 19, pp. 41-44, 2001.
Biernat, "Coating can greatly enhance carbide tool life and performance, but only if they stay in place," Cutting Tool Engineering, 47(2), Mar. 1995.
Brooks, World Dictionary and Handbook of Hardmetals and Hard Materials, International Carbide Data, Sixth edition, 1996, p. D194.
Tonshoff et al., "Surface treatment of cutting tool substrates," Int. J. Tools Manufacturing, 38(5-6), 1998, 469-476.
Bouzakis et al., "Improvement of PVD Coated Inserts Cutting Performance Through Appropriate Mechanical Treatments of Substrate and Coating Surface", Surface and Coatings Technology, 2001, 146-174; pp. 443-490.
Destefani, "Cutting tools 101: Coatings," Manufacturing Engineering, 129(4), 2002, 5 pages.
Santhanam, et al., "Comparison of the Steel-Milling Performance of Carbide Inserts with MTCVD and PVD TiCN Coatings", Int. J. of Refractory Metals & Hard Materials, vol. 14, 1996, pp. 31-40.
Wolfe et al., "The Role of Hard Coating in Carbide Milling Tools", J. Vacuum Science Technology, vol. 4, No. 6, Nov./Dec. 1986, pp. 2747-2754.
Quinto, "Mechanical Property and Structure Relationships in Hard Coatings for Cutting Tools", J. Vacuum Science Technology, vol. 6, No. 3, May/Jun. 1986, pp. 2149-2157.
The Thermal Conductivity of Some Common Materials and Gases, The Engineering ToolBox, printed from http://www.engineeringtoolbox.com/thermal-conductivity-d_429.html on Dec. 15, 2011, 4 pages.

* cited by examiner

EARTH-BORING BIT PARTS INCLUDING HYBRID CEMENTED CARBIDES AND METHODS OF MAKING THE SAME

BACKGROUND OF THE TECHNOLOGY

1. Field of the Technology

The present disclosure is directed to parts for earth-boring bits including hybrid cemented carbide composites, and also to methods of making parts for earth-boring bits including hybrid cemented carbide composites. Examples of parts for earth-boring bits included within the present disclosure include earth-boring bit bodies, roller cones, and mud nozzles.

2. Description of the Background of the Technology

Earth-boring bits used for oil and gas well drilling may have fixed or rotatable cutting elements. Fixed-cutter earth-boring bits typically include polycrystalline diamond compacts (PDCs) attached to a solid holder or bit body. Roller cone earth-boring bits typically include cemented carbide cutting inserts attached to multiple rotatable conical holders that form part of the bit. The rotatable conical holders are variously referred to in the art as "roller cones", "insert roller cones", or simply as "cones". Earth-boring bits typically are secured to the terminal end of a drill string, which is rotated from the surface or by mud motors located just above the bit on the drill string. Drilling fluid or mud is pumped down the hollow drill string and "mud nozzles" formed in the bit body. The drilling fluid or mud cools and lubricates the bit as it rotates and also carries material cut by the bit to the surface.

The bit body and other parts of earth-boring bits are subjected to many forms of wear as they operate in the harsh downhole environment. A common form of wear is abrasive wear caused by contact with abrasive rock formations. In addition, the drilling mud, which is laden with rock cuttings, causes erosive wear on the bit. The service life of an earth-boring bit is a function not only of the wear properties of the cutting elements (for example, PDCs, cemented carbide cutting inserts, or milled cutting teeth), but also is a function of the wear properties of the bit body (in the case of fixed-cutter bits) or the roller cones (in the case of roller cone bits). One way to increase the service life of an earth-boring bit is to employ bit bodies or roller cones made of materials having improved combinations of strength, toughness, and abrasion/erosion (wear) resistance.

FIG. 1 depicts a conventional roller cone earth-boring bit used for oil and gas well drilling. Roller cone earth-boring bit 10 includes bit body 12 and three rotatable conical cutters or "roller cones" 14. The bit body 12 and roller cones 14 typically are made of alloy steel. Cemented carbide cutting inserts 16 are attached about the circumference of each roller cone 14. Alternatively, the roller cones 14 may include milled cutting teeth hardfaced with tungsten carbide to improve wear resistance. Rotating the drill string causes the roller cones 14 to roll along the bottom of the drill hole, and the cutting inserts 16 sequentially contact and crush the rock in the bottom of the hole. High velocity jets of fluid pumped through fluid holes or "mud nozzles" 18 sweep the crushed rock from the bottom region and up through the drill hole. The cutting inserts 16 or teeth typically mesh to some degree as the roller cones 14 rotate, and this meshing action assists in cleaning rock from the face of the bit body 12. Attachment region 19 may be threaded and/or include other features adapted to allow the bit 10 to be connected to an end of a drill string.

FIG. 2 depicts a conventional fixed-cutter earth-boring bit body. The bit body 20 is typically made of alloy steel. According to one recent development, if a higher degree of wear and erosion resistance is desired, the bit body 20 may be formed from a cast metal-matrix composite. The composite may include, for example, carbides of tungsten bound together by a matrix of bronze, brass, or another suitable alloy characterized by a relatively low melting point. Several PDC cutters (not shown) are secured to the bit body in pockets 28, which are positioned at predetermined positions to optimize cutting performance. The bit body 20 is secured to a steel shank (not shown) that typically includes a threaded pin connection by which the bit is secured to a drive shaft of a downhole motor or a drill collar at the distal end of a drill string.

Steel bodied bits are typically machined from round stock to a desired shape, with topographical and internal features. Hard-facing techniques may be used to apply wear-resistant materials to the face of the bit body and other critical areas of the surface of the bit body.

In the conventional method for manufacturing a bit body from hard particles and a binder, a mold is milled or machined to define the exterior surface features of the bit body. Additional hand milling or clay work may also be required to create or refine topographical features of the bit body. Once the mold is complete, a preformed bit blank of steel may be disposed within the mold cavity to internally reinforce the bit body and provide a pin attachment matrix upon fabrication. Other sand, graphite, or transition or refractory metal-based inserts, such as those defining internal fluid courses, pockets for cutting elements, ridges, lands, nozzle displacements, junk slots, and/or other internal or topographical features of the bit body, may also be inserted into the cavity of the mold. Any inserts used must be placed at precise locations to ensure proper positioning of cutting elements, nozzles, junk slots, etc., in the final bit. The desired hard particles may then be placed within the mold and packed to the desired density. The hard particles are then infiltrated with a molten binder, which freezes to form a solid bit body including a discontinuous phase of hard particles embedded within a continuous phase of binder.

Recently, it has been discovered that fixed-cutter bit bodies may be fabricated from cemented carbides employing standard powder metallurgy practices (powder consolidation, followed by shaping or machining the green or presintered powder compact, and high temperature sintering). Co-pending U.S. patent application Ser. Nos. 10/848,437 and 11/116,752 disclose the use of cemented carbide composites in bit bodies for earth-boring bits, and each such application is hereby incorporated herein by reference in its entirety.

In general, cemented carbide based bit bodies provide substantial advantages over the bit bodies of the prior art, which typically are machined from steel or infiltrated carbides, since cemented carbides offer vastly superior combinations of strength, toughness, and abrasion/erosion resistance compared to steels or infiltrated carbides with copper based binders.

Referring again to FIG. 2, a typical solid, one-piece, cemented carbide bit body 20 is depicted that can be employed to make a PDC-based earth-boring bit. As can be observed, the bit body 20 essentially consists of a central portion 22 having holes 24 through which mud may be pumped, as well as arms or blades 26 having pockets 28 into which the PDC cutters are attached. The bit body 20 of FIG. 2 may be prepared by powder metal technologies. Typically, to prepare such a bit body, a mold is filled with powders that include both the binder metal and the carbide. The mold is then compacted to densify the powders and form a green compact. Due to the strength and hardness of sintered cemented carbides, the bit body is usually machined in the green compact form. The green compact may be machined to include any features desired in the final bit body. The green compact may then be sintered to achieve full or near-full density While bit bodies and holders fabricated with cemented carbide may exhibit an increased service life compared with bit bodies and holders fabricated from conventional materials, limitations remain in using cemented carbides in these applications. The grades of cemented carbide that would be suitable for use in bit bodies and holders is limited. High toughness levels are needed to withstand the high impact forces encountered during earth-boring operations but, in general, higher toughness grades are characterized by low hardness and poor wear resistance. The cemented carbide grades commonly selected for use in bit bodies and holders, therefore, typically include relatively high binder contents, such as 20 weight percent or greater, and coarse hard particle grain sizes, having an average grain size of at least 4-5 microns. Such grades typically exhibit relatively limited wear and erosion resistance levels. Therefore, although the service lives of bit bodies and holders based on such cemented carbide grades typically exceed those of brass, bronze, and steel based bodies and holders, the increase in service life has been limited by the properties of the cemented carbide grades suitable for earth-boring applications.

Accordingly, there continues to be a need for bit bodies, roller cones, mud nozzles, and other parts for earth-boring bits having an advantageous combination of wear resistance, strength, and toughness.

SUMMARY

The present disclosure addresses the foregoing need by providing articles of manufacture selected from bit bodies, roller cones, mud nozzles, and other earth-boring bit parts that include a hybrid cemented carbide composite, and to methods of making such articles. The hybrid cemented carbide composite included within articles according to the present disclosure includes a cemented carbide dispersed phase and a cemented carbide continuous phase. In one non-limiting embodiment according to the present disclosure, the contiguity ratio of the dispersed phase of the hybrid cemented carbide composite included in the article of manufacture is no greater than 0.48. In another non-limiting embodiment according to the present disclosure, the contiguity ratio of the dispersed phase of the hybrid cemented carbide composite of the article of manufacture is less than 0.4. In yet another non-limiting embodiment according to the present disclosure, the contiguity ratio of the dispersed phase of the hybrid cemented carbide composite of the article of manufacture is less than 0.2.

According to one non-limiting embodiment of an article according to the present disclosure, the hardness of the dispersed phase of a hybrid cemented carbide composite included in the part is greater than a hardness of the continuous phase of the hybrid cemented carbide composite. In another non-limiting embodiment, a hybrid cemented carbide composite included in the article includes a first cemented carbide dispersed phase and a second cemented carbide dispersed phase, wherein at least one of a composition and a physical property of the second cemented carbide dispersed phase differs from that of the first cemented carbide dispersed phase. In certain non-limiting embodiments, the physical property is selected from hardness, Palmquist toughness, and wear resistance.

In an exemplary non-limiting embodiment of the article according to the present disclosure, the cemented carbide dispersed phase of a hybrid cemented carbide included in the article is 2 to 50 volume percent of the hybrid cemented carbide. In another non-limiting embodiment of the article, the cemented carbide dispersed phase of a hybrid cemented carbide included in the article is 2 to 25 volume percent of the hybrid cemented carbide.

According to certain non-limiting embodiments of the article of manufacture according to the present disclosure, a hardness of the cemented carbide dispersed phase of a hybrid cemented carbide included in the article is at least 88 HRA and no greater than 95 HRA. In another non-limiting embodiment of the article, the Palmquist toughness of the cemented carbide continuous phase of a hybrid cemented carbide included in the article is greater than 10 $MPa \cdot m^{1/2}$. In still another non-limiting embodiment of the article, the hardness of the cemented carbide continuous phase of a hybrid cemented carbide included in the article is at least 78 HRA and no greater than 91 HRA.

Non-limiting embodiments of an article of manufacture, as disclosed herein, include those wherein the cemented carbide dispersed phase and the cemented carbide continuous phase of a hybrid cemented carbide composite included in the article independently include at least one carbide of a metal selected from Groups IVB, VB, and VIB of the Periodic Table, and a binder that includes at least one of cobalt, a cobalt alloy, nickel, a nickel alloy, iron, and an iron alloy. The binder of at least one of the cemented carbide dispersed phase and the cemented carbide continuous phase of the hybrid cemented carbide optionally may further include at least one alloying agent selected from tungsten, titanium, tantalum, niobium, aluminum, chromium, copper, manganese, molybdenum, boron, carbon, silicon, and ruthenium. In one non-limiting embodiment of an article of manufacture according to the present disclosure, the alloying agent is present in a concentration of up to 20 weight percent of the binder of a hybrid cemented carbide included in the article.

According to certain non-limiting embodiments of articles according to the present disclosure, the binder concentration of the dispersed phase of a hybrid cemented carbide included in the article is 2 to 15 weight percent of the dispersed phase, and the binder concentration of the continuous phase is 6 to 30 weight percent of the continuous phase. According to yet another non-limiting embodiment, both the cemented carbide dispersed phase and the cemented carbide continuous phase of a hybrid cemented carbide included in the article include tungsten carbide and cobalt.

Aspects of the instant disclosure include earth-boring bit parts that include a hybrid cemented carbide. In a non-limiting embodiment the hybrid cemented carbide includes: a cemented carbide dispersed phase wherein the volume fraction of the dispersed phase is less than 50 volume percent of the hybrid cemented carbide composite; and a cemented carbide continuous phase. A physical property of the cemented carbide dispersed phase and the cemented carbide continuous phase differs, and the cemented carbide dispersed phase has a contiguity ratio less than 1.5 times the volume fraction of the cemented carbide dispersed phase in the hybrid cemented carbide.

In non-limiting embodiments of an earth-boring bit part disclosed herein, the cemented carbide dispersed phase and the cemented carbide continuous phase each independently include at least one carbide of at least one transition metal selected from the group consisting of titanium, chromium, vanadium, zirconium, hafnium, tantalum, molybdenum, niobium, and tungsten; and a binder that includes at least one of cobalt, a cobalt alloy, nickel, a nickel alloy, iron, and an iron alloy. In another non-limiting embodiment of an earth-boring bit part according to the present disclosure, the binder further includes at least one alloying agent selected from tungsten, titanium, tantalum, niobium, aluminum, chromium, copper, manganese, molybdenum, boron, carbon, silicon, and ruthenium.

In an exemplary, non-limiting embodiment according to the present disclosure, a hybrid cemented carbide composite included in an earth-boring bit part has a wear resistance greater than 0.7 $mm^{-3}$ and a Palmquist toughness greater than 10 $MPa \cdot m^{1/2}$. In certain non-limiting embodiments, the earth-boring bit part is one of a bit body, a roller cone, and a mud nozzle.

According to an aspect of the present disclosure, a method of making a part for an earth-boring bit part includes: combining a portion of a first grade of a cemented carbide powder and a portion of a second grade of a cemented carbide powder to provide a powder blend; consolidating at least a portion of the powder blend into a green compact, where the first grade of a cemented carbide powder is a dispersed phase of the green compact and the second grade of a cemented carbide powder is a continuous phase of the green compact; and partially or fully sintering the green compact to form a densified compact comprising a hybrid cemented carbide composite including a cemented carbide dispersed phase and a cemented carbide continuous phase. In a non-limiting embodiment, the contiguity ratio of the dispersed phase of the hybrid cemented carbide composite is no more than 0.48. In another non-limiting embodiment, the contiguity ratio of the dispersed phase of the hybrid cemented carbide composite is less than 0.4. In yet another non-limiting embodiment, the contiguity ratio of the dispersed phase of the hybrid cemented carbide composite is less than 0.2.

Another non-limiting embodiment of a method of making a part for an earth-boring bit as disclosed herein includes selecting first and second cemented carbide powders for the powder blend so that a dispersed phase of a hybrid cemented carbide composite included in the part has a hardness greater than the hardness of the continuous phase of the hybrid cemented carbide composite. In still another non-limiting embodiment, a third cemented carbide powder is combined with the first and second cemented carbide powders to provide the powder blend so that a hybrid cemented carbide composite included in the part includes a cemented carbide continuous phase, a first cemented carbide dispersed phase suspended in the continuous phase, and a second cemented carbide dispersed phase suspended in the continuous phase. According to one non-limiting embodiment, at least one of a composition and a property of the first cemented carbide dispersed phase of the hybrid cemented carbide differs from the second cemented carbide dispersed phase. In certain non-limiting embodiments, the property that differs is selected from hardness, Palmquist toughness, and wear resistance.

In one non-limiting embodiment of a method of making an earth-boring bit part according to the present disclosure, the cemented carbide dispersed phase of a hybrid cemented carbide included in the part is between 2 and 50 percent by volume of the hybrid cemented carbide composite. In another non-limiting method embodiment, the cemented carbide dispersed phase of the hybrid cemented carbide composite is between 2 and 25 percent by volume of the hybrid cemented carbide composite. Also, in certain non-limiting method embodiments, the cemented carbide grades are chosen so that the hardness of the cemented carbide dispersed phase of a hybrid cemented carbide composite included in the part is at least 88 HRA and no greater than 95 HRA. In another non-limiting embodiment, the Palmquist toughness of the cemented carbide continuous phase of the hybrid cemented carbide composite is greater than 10 $MPa \sim m^{1/2}$. In another non-limiting method for making an earth-boring bit part, the hardness of the cemented carbide continuous phase of a hybrid cemented carbide composite included in the part is at least 78 HRA and no greater than 91 HRA.

According to one non-limiting embodiment of a method of making an earth-boring bit part according to the present disclosure, the cemented carbide dispersed phase and the cemented carbide continuous phase of a hybrid cemented carbide composite included in the part are independently chosen and each include at least one carbide of a metal selected from Groups IVB, VB, and VIB of the Periodic Table, and a binder that includes at least one of cobalt, a cobalt alloy, nickel, a nickel alloy, iron, and an iron alloy. In a non-limiting embodiment, the continuous phase (binder) of at least one of the cemented carbide dispersed phase and the cemented carbide continuous phase includes at least one alloying agent selected from tungsten, titanium, tantalum, niobium, aluminum, chromium, copper, manganese, molybdenum, boron, carbon, silicon, and ruthenium. According to certain non-limiting embodiments, the alloying agent is included in a concentration that is up to 20 weight percent of the binder.

One non-limiting embodiment of a method for making an earth-boring bit part, as disclosed herein, includes providing a hybrid cemented carbide in the part wherein a binder concentration of the dispersed phase of the hybrid cemented carbide is 2 to 15 weight percent of the dispersed phase, and a binder concentration of the continuous phase of the hybrid cemented carbide is 6 to 30 weight percent continuous phase.

According to a non-limiting embodiment of a method for making an earth-boring bit part according to the present disclosure, the part includes a hybrid cemented carbide wherein the volume fraction of the cemented carbide dispersed phase of the hybrid cemented carbide is less than 50 volume percent of the hybrid cemented carbide, and wherein the cemented carbide dispersed phase of the hybrid cemented carbide has a contiguity ratio that is less than 1.5 times the volume fraction of the cemented carbide dispersed phase in the hybrid cemented carbide composite.

In one non-limiting embodiment of a method for making an earth-boring bit part according to the present disclosure, a hybrid cemented carbide composite included in the part has a wear resistance greater than 0.7 $mm^{-3}$ and a Palmquist toughness greater than 10 $MPa \cdot m^{1/2}$.

According to one non limiting embodiment of a method for making an earth-boring bit part, the method includes: combining a portion of a first grade of a cemented carbide powder and a portion of a second grade of a cemented carbide powder to provide a powder blend; consolidating at least a portion of the powder blend into a green compact, wherein the first grade of a cemented carbide powder is a dispersed phase of the green compact and the second grade of a cemented carbide powder is a continuous phase of the green compact; presintering the green compact to form a brown compact; and sintering the brown compact to form a densified compact comprising a hybrid cemented carbide composite including a cemented carbide dispersed phase and a cemented carbide continuous phase. In a non-limiting embodiment, prior to sintering the brown compact, the brown compact is machined. In another non-limiting embodiment of the method, machining the brown compact includes machining at least one cutter insert pocket in the brown compact. In still another non-limiting embodiment, prior to presintering the green compact, the green compact is machined. In yet another embodiment, machining the green compact includes machining at least one cutter insert pocket in the green compact.

According to certain non-limiting embodiments of the above method, consolidating at least a portion of the powder blend includes pressing the at least a portion of the powder blend. In still another non-limiting embodiment, pressing the at least a portion of the powder blend includes isostatically pressing the at least a portion of the powder blend.

According to certain non-limiting embodiments of the above method, the first grade of a cemented carbide powder and the second grade of a cemented carbide powder combined to form the powder blend each independently include a transition metal carbide selected from the group consisting of titanium carbide, chromium carbide, vanadium carbide, zirconium carbide, hafnium carbide, tantalum carbide, molybdenum carbide, niobium carbide, and tungsten carbide.

According to certain non-limiting embodiments of the above method, sintering the brown compact to form a densified compact includes sintering the brown compact at a liquid phase temperature. Another non-limiting embodiment of the method includes sintering the brown compact at a pressure of 300 to 2000 psi and a temperature of 1350° C. to 1500° C.

According to one non-limiting method, the hybrid cemented carbide composite included in an earth-boring bit part according to the present disclosure includes a first region having a first hybrid cemented carbide composite composition and a second region having a second hybrid cemented carbide composite composition. In one non-limiting embodiment of the above method the method includes, prior to consolidating at least a portion of the powder blend into a green compact: placing at least a portion of a first powder blend for forming a first hybrid cemented carbide composite composition into a first region of a void of a mold; placing at least a portion of a second powder blend for forming a second hybrid cemented carbide composite composition into a second region of the void of a mold; and consolidating the powder blends placed in the void of the mold by pressing the powder blends within the void of the mold, thereby providing the green compact.

In an embodiment that is not meant to be limiting, a method for making an earth-boring bit part according to the present disclosure includes forming a fixed-cutter bit body including a hybrid cemented carbide having transverse rupture strength greater than 300 ksi. In another non-limiting embodiment, the hybrid cemented carbide in the formed fixed-cutter bit body has a Young's modulus greater than 55,000,000 psi.

BRIEF DESCRIPTION OF THE DRAWINGS

The features and advantages of articles and methods described herein may be better understood by reference to the accompanying drawings in which.

Figure 1:
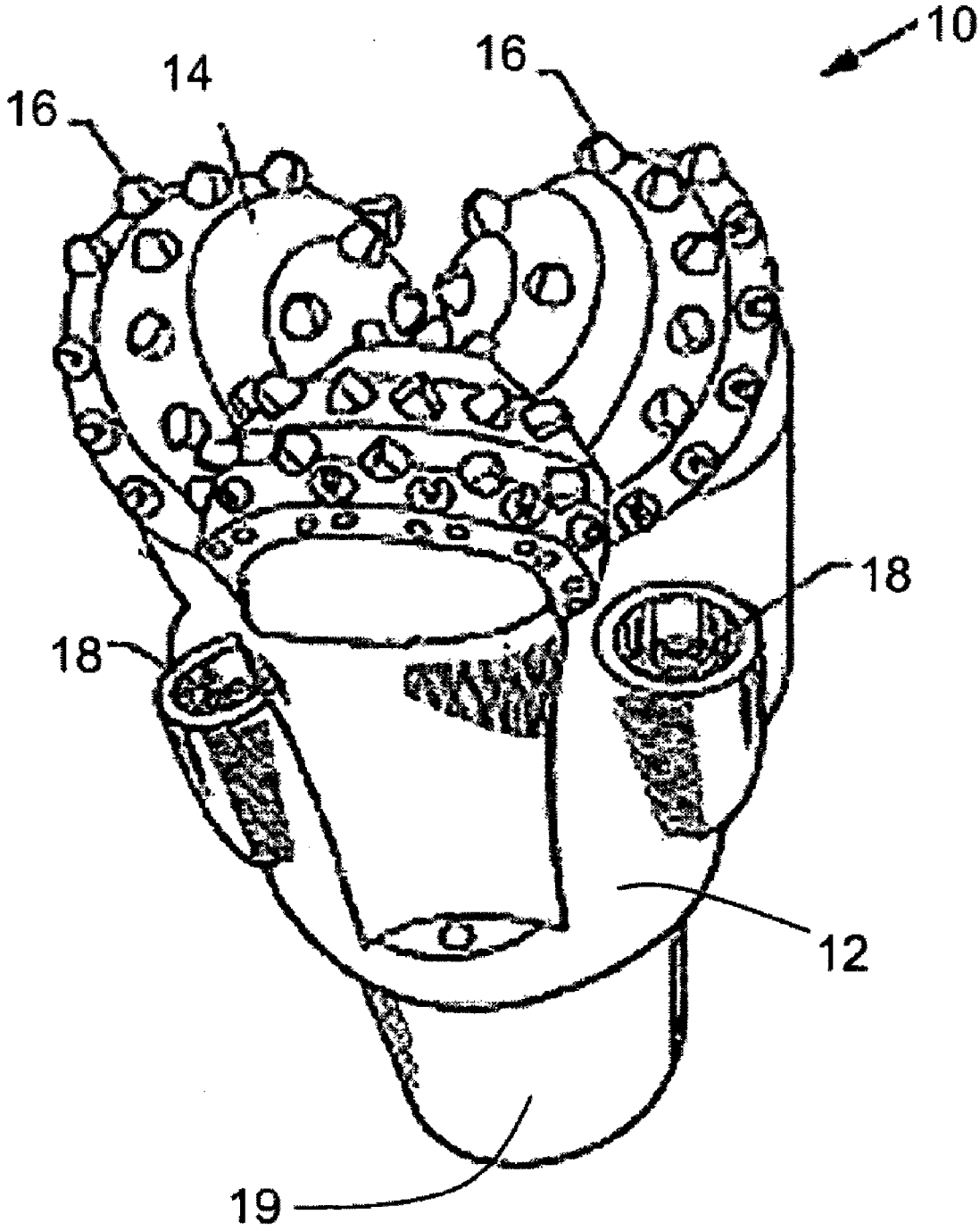
FIG. 1 (PRIOR ART)
FIG. 1 is a schematic perspective view of a conventional roller cone earth-boring bit.

The reader will appreciate the foregoing details, as well as others, upon considering the following detailed description of certain non-limiting embodiments according to the present disclosure.

DETAILED DESCRIPTION OF CERTAIN NON-LIMITING EMBODIMENTS

In the present description of non-limiting embodiments, other than in the operating examples or where otherwise indicated, all numbers expressing quantities or characteristics are to be understood as being modified in all instances by the term "about". Accordingly, unless indicated to the contrary, any numerical parameters set forth in the following description are approximations that may vary depending on the desired properties one seeks to obtain in the parts and methods according to the present disclosure. At the very least, and not as an attempt to limit the application of the doctrine of equivalents to the scope of the claims, each numerical parameter described in the present description should at least be construed in light of the number of reported significant digits and by applying ordinary rounding techniques.

Any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

Embodiments according to the present disclosure are directed to novel parts for earth boring bits. Such parts include, for example, earth-boring bit bodies, roller cones, mud nozzles, and teeth for roller cone earth-boring bits. Embodiments according to the present disclosure also are directed to methods of making the novel parts for earth boring bits described herein. Although the present description necessarily only refers to a limited number of parts for earth boring bits, it will be understood that the present invention is broad enough to encompass any earth-boring bit part that would benefit from the novel design and/or the novel method of making discussed herein.

Embodiments of the earth-boring bit body parts according to the present description include hybrid cemented carbide composites or, simply, "hybrid cemented carbides". As is known to those having ordinary skill, a cemented carbide is a composite material that typically includes a discontinuous phase of hard metal carbide particles dispersed throughout and embedded within a continuous binder phase. As is also known to those having ordinary skill, a hybrid cemented carbide is a composite that may include a discontinuous phase of hard particles of a first cemented carbide grade dispersed throughout and embedded within a continuous binder phase of a second cemented carbide grade. As such, a hybrid cemented carbide may be a composite of cemented carbides.

The hard metal carbide phase of each cemented carbide of a hybrid cemented carbide typically comprises a carbide of one or more of the transition metals, which are the elements found in Groups IVB, VB, and VIB of the Periodic Table. Transition metals typically applied in cemented carbides include, for example, titanium, vanadium, chromium, zirconium, hafnium, molybdenum, niobium, tantalum, and tungsten. The continuous binder phase, which binds or "cements" together the metal carbide grains typically is selected from cobalt, a cobalt alloy, nickel, a nickel alloy, iron, and an iron alloy. Additionally, one or more alloying elements such as, for example, tungsten, titanium, tantalum, niobium, aluminum, chromium, copper, manganese, molybdenum, boron, carbon, silicon, and ruthenium, may be added to enhance certain properties of the composites. In one non-limiting embodiment of a earth-boring bit part selected from a bit body, a roller cone, and a mud nozzle according to the present disclosure, the part is made of a hybrid cemented carbide in which the binder concentration of the dispersed phase of the hybrid cemented carbide is 2 to 15 weight percent of the dispersed phase, and the binder concentration of the continuous binder phase of the hybrid cemented carbide is 6 to 30 weight percent of the continuous binder phase.

The hybrid cemented carbides of certain non-limiting embodiments of earth-boring bit parts described herein have relatively low contiguity ratios, which improves certain properties of the hybrid cemented carbides relative to other cemented carbides. Non-limiting examples of hybrid cemented carbides that may be used in embodiments of earth-boring bit parts according to the present disclosure are found in U.S. Pat. No. 7,384,443, which is hereby incorporated by reference herein in its entirety.

Figure 3:
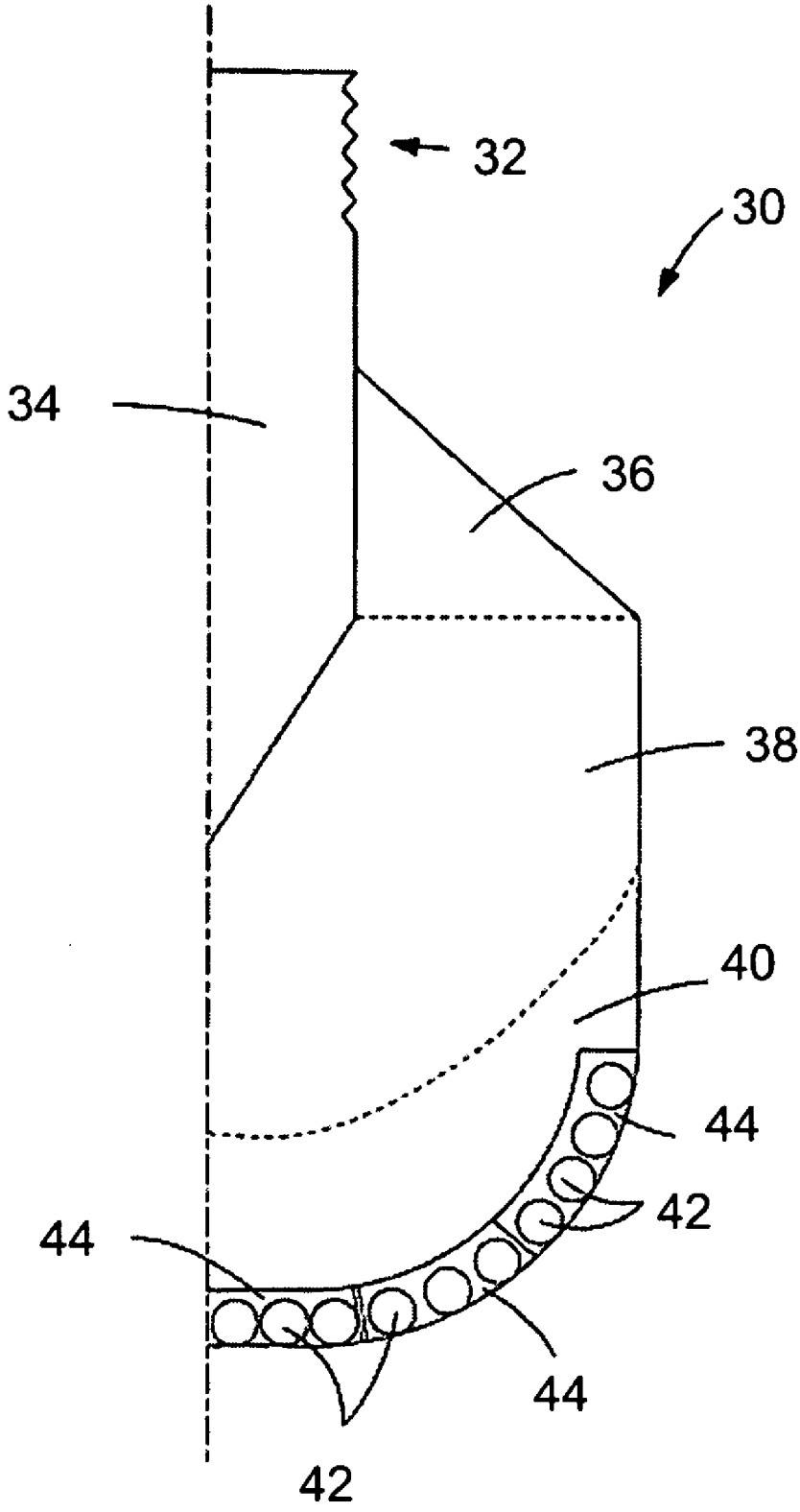
FIG. 3 is a schematic cross-sectional view on an embodiment of a bit body for an earth-boring bit.

A cross-section of a fixed-cutter earth-boring bit body 30 is shown in the schematic cross-sectional view of FIG. 3, and is provided as a non-limiting example of an earth-boring bit body according to the present disclosure. Generally, bit body 30 may include attachment means 32 (threads are shown in FIG. 3) on shank 34, which is attached to the bit body 30. In certain non-limiting embodiments disclosed herein, shank 34 and attachment means 32 may each independently be made of steel, another metallic alloy, a composite of a discontinuous hard phase and a continuous binder phase, or a hybrid cemented carbide. Shank 34 may be attached to the bit body 30 by any method such as, but not limited to, brazing, threaded connection, pins, keyways, shrink fits, adhesives, diffusion bonding, interference fits, or any other suitable mechanical or chemical connection.

Bit body 30 may be constructed to include various regions, wherein at least one region includes a hybrid cemented carbide. In one non-limiting embodiment, a hybrid cemented carbide composite included in a region of bit body 30 has a contiguity ratio of 0.48 or less. In another non-limiting embodiment, each of several regions of bit body 30 includes a hybrid cemented carbide, and each such hybrid cemented carbide may be the same as or different from other hybrid cemented carbides in the bit body 30. In one non-limiting embodiment, the hybrid cemented carbide in each region of bit body 30 differs from another hybrid cemented carbide in the bit body 10 in terms of at least one of composition and properties. Differences in hybrid cemented carbides within bit body 30 may result from differences in concentration, size, and/or composition of the metal carbide particles in the discontinuous and/or continuous phase of the hybrid cemented carbides. Differences in hybrid cemented carbides within bit body 30 also may result from differences in the binders in the discontinuous and/or continuous phase of the hybrid cemented carbides. Also, differences in hybrid cemented carbides within the bit body 30 may be the result of differences in the concentration of one cemented carbide grade dispersed in (i.e., discontinuous) throughout a second cemented carbide continuous phase. The use of any combination of hard particle sizes and binders providing a hybrid cemented carbide having suitable properties for earth-boring applications is within the scope of the present disclosure. The present disclosure encompasses any earth-boring bit part possible wherein at a portion of a region of the part is composed of a hybrid cemented carbide including a cemented carbide dispersed phase dispersed and embedded in a cemented carbide continuous phase. In a non-limiting embodiment, at least a portion of the bit body, a roller cone, or a mud nozzle includes a hybrid cemented carbide composite having a contiguity ratio of the dispersed phase that is no greater than 0.48. Providing different hybrid cemented carbides in different regions or portions of regions in the bit body allows one to tailor the properties in specific regions or region portions to address the particular physical demands on the region or portion during the earth boring operation. As such, the earth-boring bit body or other part may be designed according to the present invention so that the properties or composition of regions or region portions change abruptly or more gradually between different regions or portions.

In a non-limiting embodiment of a bit body, roller cone, or mud nozzle, the dispersed phase of the hybrid cemented carbide includes between 2 and 50 volume percent of the total hybrid cemented carbide.

In one non-limiting example of a bit body according to the present disclosure, bit body 30 of FIG. 3 includes three distinct regions: top region 36, mid-region 38, and bottom region 40. In one non-limiting embodiment, each of the top 36, mid 38, and bottom 40 regions are fabricated from a hybrid cemented carbide composite. The hybrid cemented carbides in each of regions 36, 38, and 40 may all be of the same composition, including hybrid cemented carbides with dispersed and continuous phases composed of like cemented carbide grades. In another non-limiting embodiment, each region 36, 38, and 40 includes a different hybrid cemented carbide. It will be understood that the variations between hybrid cemented carbides in the regions 36, 38, and 40 may be achieved by, for example, one or more of: varying the concentrations of dispersed and continuous phases in a hybrid cemented carbide; varying the identities of the cemented carbides used to form the dispersed and/or continuous phases of a hybrid cemented carbide; and varying the morphology (e.g., size and/or shape) of the cemented carbide particles forming the discontinuous phase of hybrid cemented carbide. In certain non-limiting embodiments, the hybrid cemented carbide in at least one region of the bit body 30 includes a dispersed phase having a contiguity ratio no greater than 0.48. It is noted that although FIG. 3 depicts an exemplary fixed-cutter earth boring bit, the discussion herein regarding variations between regions and region portions in bit body 30 applies equally to all earth-boring bit parts encompassed by the present disclosure.

In another non-limiting embodiment of an earth-boring bit part according to the present disclosure, an earth-boring bit body, roller cone, or mud nozzle includes at least a region composed of a hybrid cemented carbide, and other regions of the body, cone, or nozzle are fabricated from other, conventional materials. Such conventional materials include, for example, steel, or a composite including hard particles dispersed in a copper-containing alloy such as, for example, a brass, a bronze, cobalt, a cobalt alloy, nickel, a nickel alloy, iron, or an iron alloy. For example, referring to FIG. 3, top region 36 may include a discontinuous hard phase of tungsten and/or tungsten carbide particles, mid region 38 may include a discontinuous hard phase of cast carbide, tungsten carbide, and/or sintered cemented carbide particles, and bottom region 40 may include a hybrid cemented carbide composite. In a non-limiting embodiment, the contiguity ratio of the dispersed phase of the hybrid cemented carbide in bottom region 40 is no greater than 0.48. Any arrangement of materials of an earth-boring bit part is within the scope of embodiments herein, so long as a region or portion of a region of the part includes a hybrid cemented carbide.

Again referring to FIG. 3, bit body 30 may include a series of cutting insert pockets 42 disposed along a peripheral portion of bottom region 40, and cutting inserts may be secured within the pockets. The pockets 42 may be directly molded into the bit body 30 or may be machined into a green or brown compact formed as an intermediate during fabrication of the bit body 30. Cutting inserts, such as, but not limited to polycrystalline diamond compacts (PCD), may be attached in the pockets brazing or other attachment methods, as described above, for example. Bit body 30 may also include internal fluid courses, ridges, lands, nozzles, junk slots, and other conventional topographical features of earth-boring bit bodies. Optionally, these topographical features may be provided by incorporating preformed inserts into the bit body 30 during its manufacture. An example is insert 44 that defines the insert pockets and that has been positioned and secured at a peripheral location on bit body 30 by suitably positioning the insert 44 in the mold used to form the bit body 30. According to certain non-limiting embodiments, an insert such as, for example, insert 44 of bit body 30, is composed of a hybrid cemented carbide. In certain non-limiting embodiments, the contiguity ratio of the dispersed phase of a hybrid cemented carbide included in bit body 30, such as the hybrid cemented carbide included in insert 44, is no greater than 0.48. It will be understood that although the foregoing description of the use and construction of inserts is provided in connection with insert 44 of bit body 30, inserts composed of hybrid cemented carbide or other materials and having a desired construction may be included in any earth-boring bit part according to the present disclosure.

Figure 4:
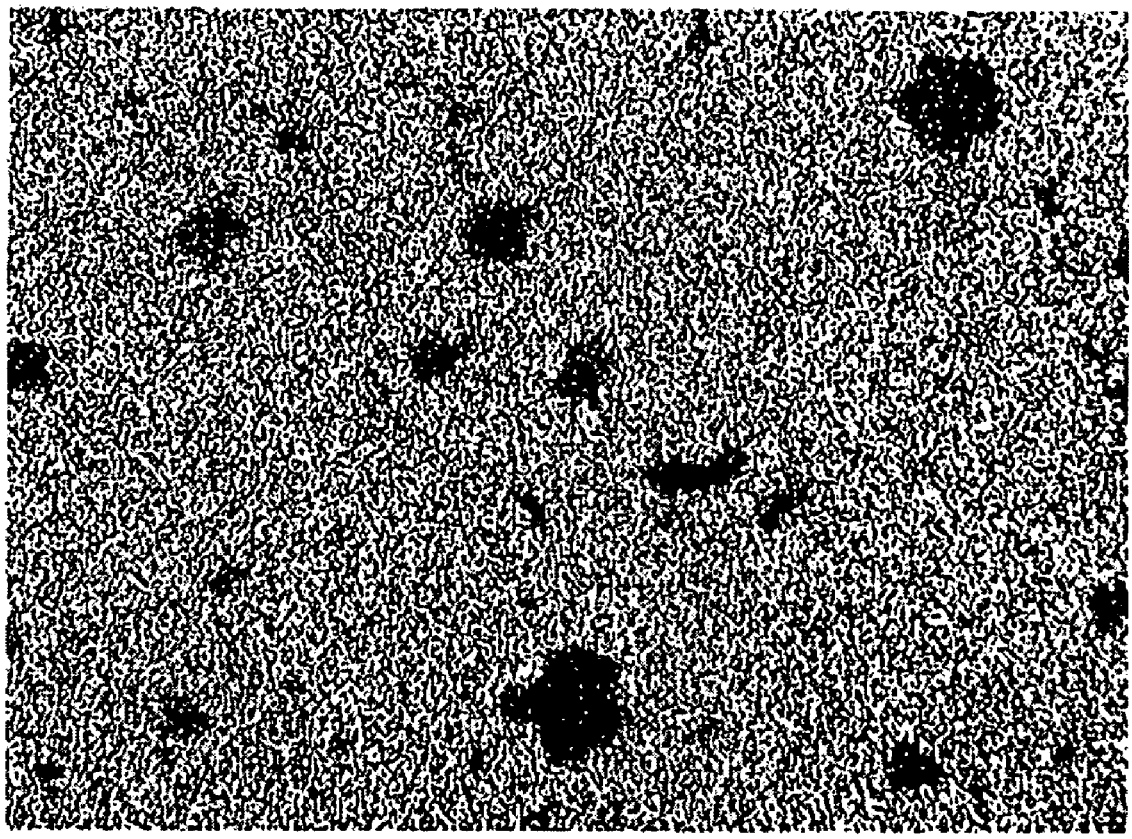
FIG. 4 is a photomicrograph of the microstructure of a hybrid cemented carbide composite in one non-limiting embodiment of an earth-boring bit according to the present disclosure.

Certain embodiments of methods of forming hybrid cemented carbide composites having a contiguity ratio of the dispersed phase that is no greater than 0.48 are found in U.S. Pat. No. 7,384,443, which is hereby incorporated by reference herein in its entirety. FIG. 4 is a photomicrograph of one non-limiting embodiment of a hybrid cemented carbide useful in the present invention and having a dispersed phase contiguity ratio equal to 0.26, as disclosed herein. The light material matrix in FIG. 4 is the cemented carbide continuous binder phase, and the dark islands of material are the cemented carbide particles dispersed and embedded within the binder phase of the dispersed phase of the hybrid cemented carbide. A brief discussion of a method for measuring contiguity ratios of hybrid cemented carbide composites follows. Also provided below are non-limiting examples of methods of preparing hybrid cemented carbides for use in earth-boring bit bodies, roller cones, mud nozzles, and other earth-boring bit parts.

Figure 5:
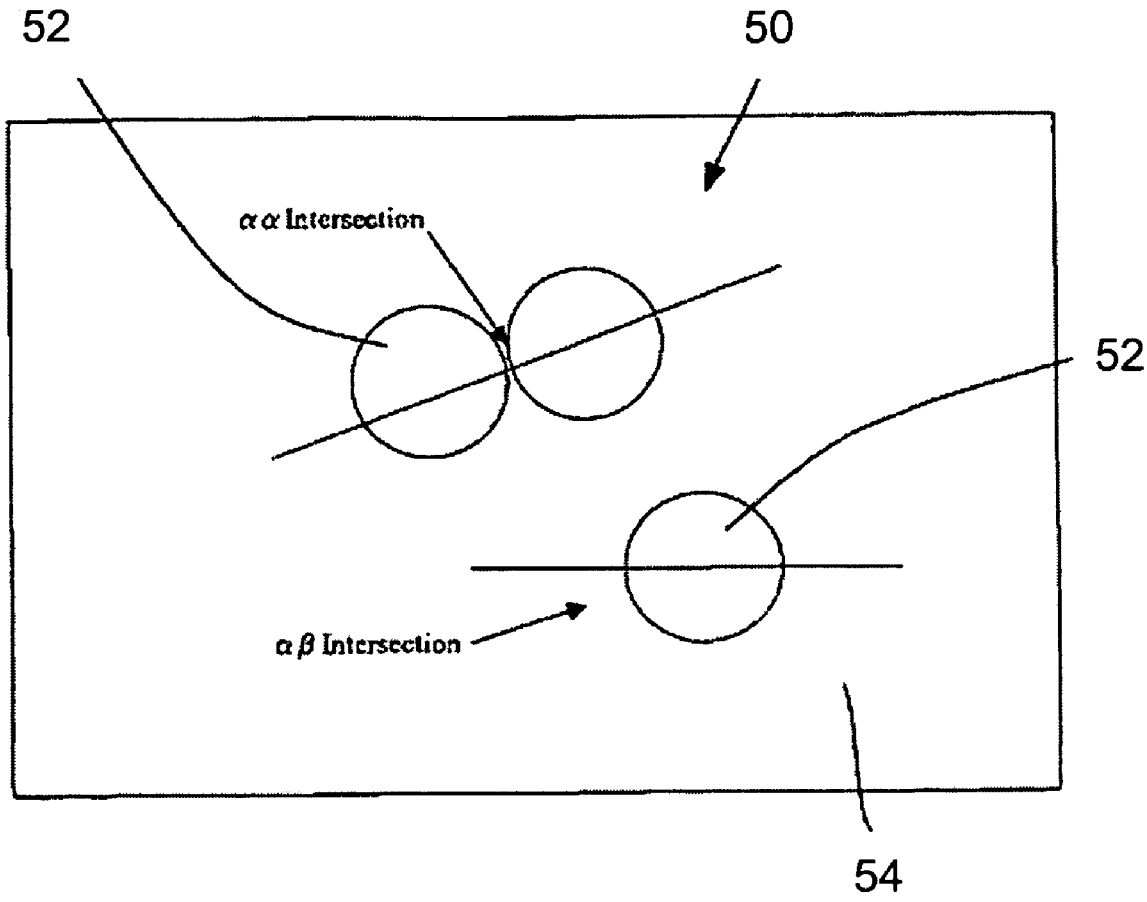
FIG. 5 schematically illustrates a method for determining contiguity values of hybrid cemented carbide composites.

The degree of dispersed phase contiguity in composite structures may be characterized as the "contiguity ratio", $C_t$. $C_t$ may be determined using a quantitative metallography technique described in Underwood, *Quantitative Stereology*, pp. 25-103 (1970), which is hereby incorporated herein by reference. The technique consists of determining the number of intersections that randomly oriented lines of known length, placed on the microstructure of a photomicrograph of the material, make with specific structural features. The total number of intersections of the lines (L) with dispersed phase/dispersed phase interfaces ($\alpha\alpha$) are counted and are designated as $N_{L\alpha\alpha}$. The total number of intersections of the lines (L) with dispersed phase/continuous phase interfaces ($\alpha\beta$) also are counted and are designated as $N_{L\alpha\beta}$. FIG. 5 schematically illustrates the procedure through which the values for $N_{L\alpha\alpha}$ and $N_{L\alpha\beta}$ are obtained. In FIG. 5, composite 50 includes dispersed phase particles 52 (a phase) in a continuous phase 54 ($\beta$ phase). The topmost line in FIG. 5 intersect one $\alpha\alpha$ interface and two $\alpha\beta$ interfaces, and the lower line intersects two $\alpha\beta$ interfaces. The contiguity ratio, $C_t$, is calculated by the equation $C_t=2N_{L\alpha\alpha}/(N_{L\alpha\beta}+2N_{L\alpha\alpha})$.

Contiguity ratio is a measure of the average fraction of the surface area of dispersed phase particles in contact with other dispersed phase particles. The contiguity ratio may vary from 0 to 1 and approaches 1 as the distribution of the dispersed particles moves from completely dispersed (i.e., no particle-particle contact) to a fully agglomerated structure. The contiguity ratio describes the degree of continuity of dispersed phase irrespective of the volume fraction or size of the dispersed phase regions. However, typically, for higher volume fractions of the dispersed phase, the contiguity ratio of the dispersed phase will also be higher.

It has been observed that in the case of hybrid cemented carbides having a hard cemented carbide dispersed phase, lower contiguity ratios correspond to a lower risk that a crack in the composite will propagate through contiguous hard phase regions. This cracking process may be a repetitive process, with cumulative effects resulting in a reduction in the overall toughness of the hybrid cemented carbide article, e.g., an earth-boring bit body, roller cone, or mud nozzle as described herein.

In certain non-limiting embodiments of bit bodies, roller cones, mud nozzles, and other earth-boring bit parts as disclosed herein, the hybrid cemented carbide included in such parts may include between about 2 to about 40 vol. % of the cemented carbide grade forming the continuous binder phase of the hybrid cemented carbide. In other embodiments, the hybrid cemented carbides may include between about 2 to about 30 vol. % of the cemented carbide grade forming the continuous binder phase of the hybrid cemented carbide. In certain applications, it may be desirable to include between 6 and 25 volume % of the cemented carbide grade forming the continuous binder phase of the hybrid cemented carbide in the hybrid cemented carbide.

Figure 6:
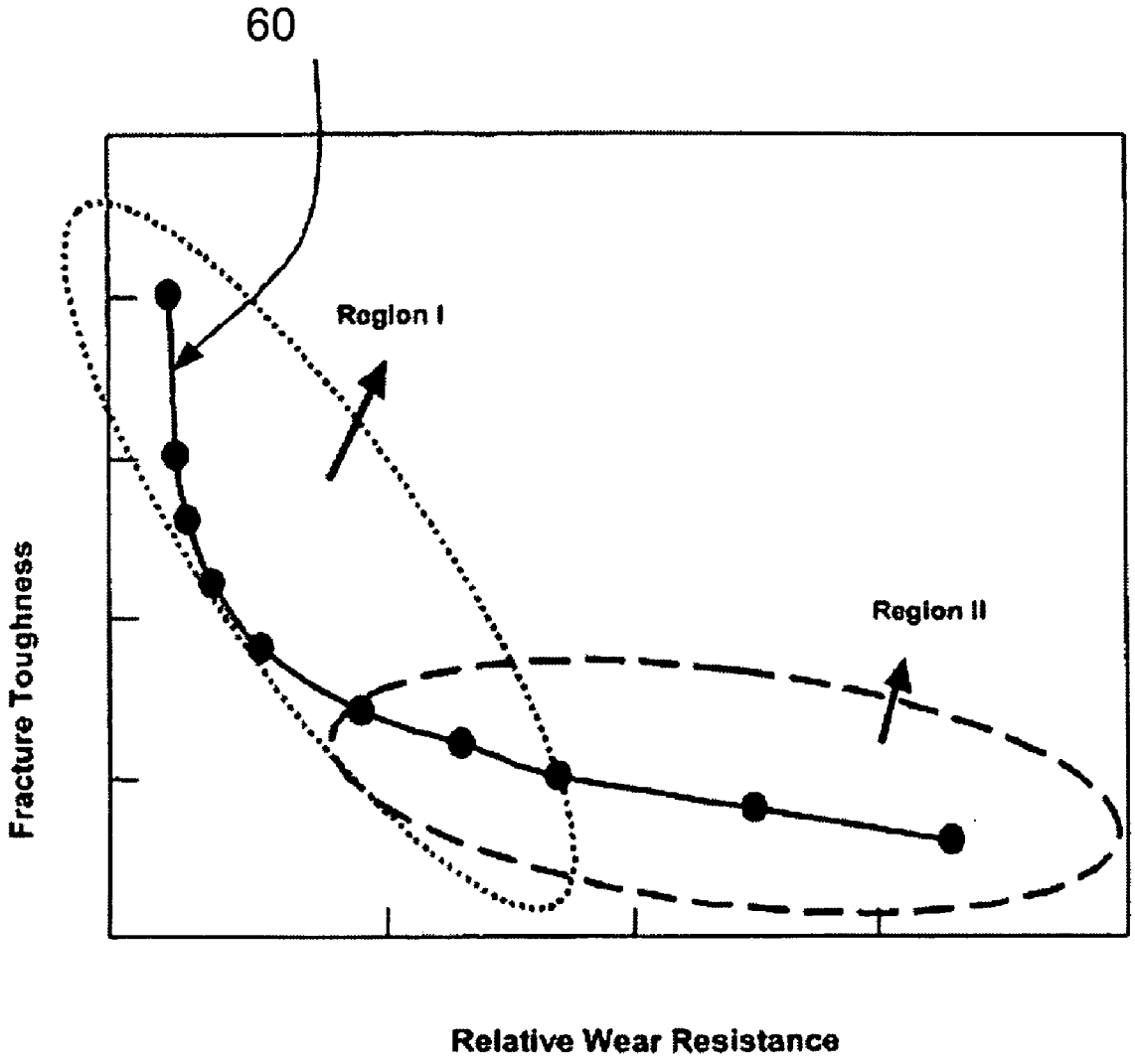
FIG. 6 is a graph of fracture toughness as a function of relative wear resistance and illustrates the enhanced wear resistance of hybrid cemented carbide composites useful in non-limiting embodiments according to this disclosure compared with conventional single-grade cemented carbide composites.

FIG. 6 illustrates the relationship that exists between fracture toughness and wear resistance in conventional cemented carbide grades comprising tungsten carbide and cobalt. The fracture toughness and wear resistance of a particular conventional cemented carbide grade will typically fall in a narrow band enveloping the solid trend line 60 shown.

As FIG. 6 shows, conventional cemented carbides may generally be classified in at least two groups: (i) relatively tough grades shown in Region I; and (ii) relatively wear resistant grades shown in Region II. Generally, the wear resistant grades included in Region II are based on relatively small metal carbide grain sizes (typically about 2 μm and below) and binder contents ranging from about 3 weight percent up to about 15 weight percent. Grades such as those in Region II are most often used for tools for cutting and forming metals due to their ability to retain a sharp cutting edge and their relatively high level of wear resistance. Conversely, the relatively tough grades included in Region I are generally based on relatively coarse metal carbide grains (typically about 3 μm and above) and binder contents ranging from about 6 weight percent up to about 30 weight percent. Grades based on coarse metal carbide grains find extensive use in applications in which the material is subjected to shock and impact, and undergoes abrasive wear and thermal fatigue. Common applications for coarse-grained cemented carbide grades include tools for mining and earth drilling, hot rolling of metals, and impact forming of metals (such as, for example, cold heading).

As discussed above, hybrid cemented carbides may be defined as a composite of cemented carbides. Non-limiting examples of hybrid cemented carbides may comprise a cemented carbide grade selected from Region I and a cemented carbide grade selected from Region II of FIG. 6. In such case, one cemented carbide grade would be present as the dispersed phase and would be embedded within a continuous phase of the second cemented carbide grade. Certain non-limiting embodiments of a hybrid cemented carbide that may be included in the earth-boring bit parts according to the present disclosure include a cemented carbide dispersed phase and a cemented carbide continuous phase wherein the cemented carbide continuous phase has at least one property, such as, for example, strength, abrasion resistance, or toughness, that differs from that of the cemented carbide dispersed phase. In one non-limiting embodiment, the hardness of a cemented carbide dispersed phase of a hybrid cemented carbide included in bit bodies, roller cones, mud nozzles, and other earth-boring bit parts according to the present disclosure is at least 88 HRA and is no greater than 95 HRA. In another non-limiting embodiment, the Palmquist toughness of the cemented carbide continuous phase of a hybrid cemented carbide included in earth-boring bit parts according to the present disclosure is greater than 10 $MPa \cdot m^{1/2}$. Instill another non-limiting embodiment, the hardness of the cemented carbide continuous phase of a hybrid cemented carbide included in bit bodies, roller cones, mud nozzles, and other earth-boring bit parts according to the present disclosure is at least 78 HRA and no greater than 91 HRA.

In a non-limiting embodiment, a hybrid cemented carbide used in bit bodies, roller cones, mud nozzles, and other earth-boring bit parts may include a second cemented carbide dispersed phase having at least one of a composition and a property that differs from that of the first cemented carbide dispersed phase. Differences in properties of the two dispersed phases may include, but are not limited to, one or more of hardness, Palmquist toughness, and wear resistance. In other possible embodiments, more than two different cemented carbide dispersed phases are included in a single hybrid cemented carbide.

Figure 7A:
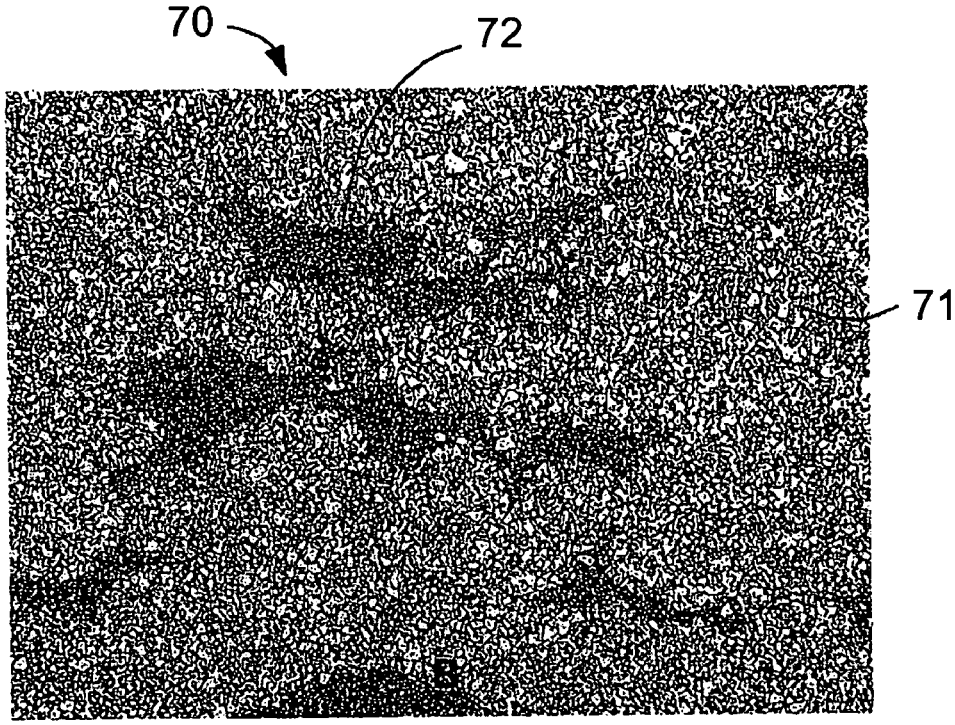
FIG. 7A (PRIOR ART)
FIG. 7A is a photomicrograph of a hybrid cemented carbide composite having a contiguity ratio greater than 0.48.
Figure 7B:
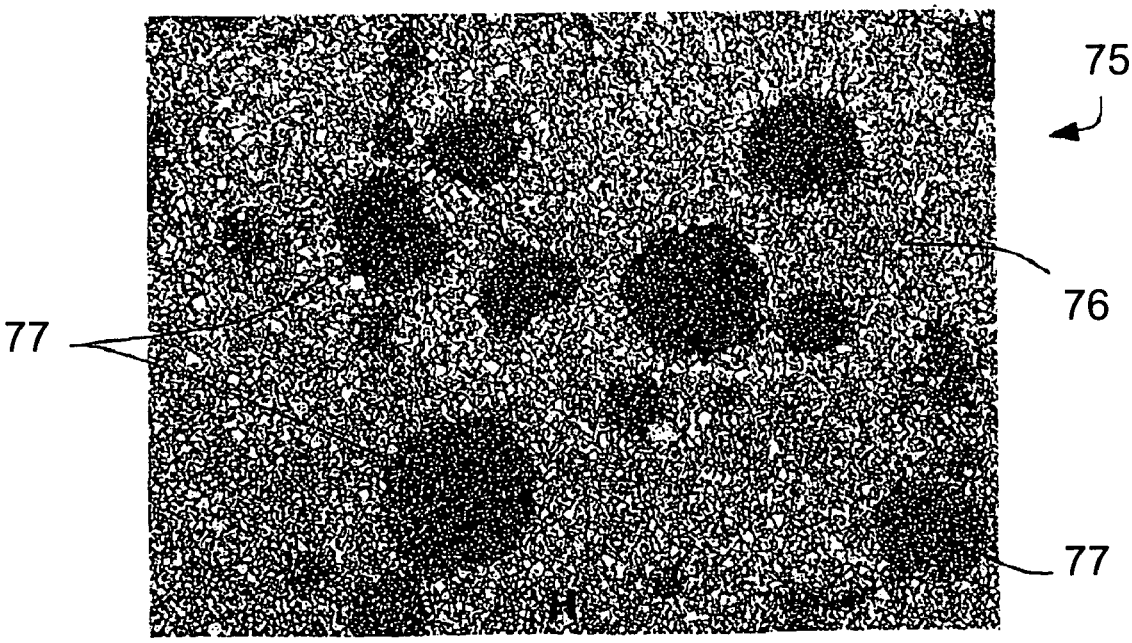
FIG. 7B is photomicrograph of a hybrid cemented carbide composite having a contiguity ratio no greater than 0.48.

Non-limiting examples of certain hybrid cemented carbides useful in the parts according to the present disclosure are illustrated in FIGS. 7A and 7B. A known hybrid cemented carbide material 70 is shown in the photomicrograph of FIG. 7A. Material 70 includes a continuous phase 71 of a cemented carbide grade commercially available as grade 2055™ cemented carbide from ATI Firth Sterling, Madison, Ala. As is familiar to those of ordinary skill in the art, Firth Sterling™ grade 2055™ cemented carbide is sold in a powder form and must be processed using conventional press-and-sinter techniques to form the cemented carbide composite material from the powder. (The present disclosure may refer to a cemented carbide "powder" when discussing the powdered material from which a final cemented carbide composite material is made.) Grade 2055™ cemented carbide is a wear resistant cemented carbide of moderate hardness and includes 90 wt. % of tungsten carbide particles having an average grain size of 4 to 6 μm as a discontinuous phase, and 10 wt. % of cobalt as a continuous binder phase. The properties of grade 2055™ cemented carbide include hardness of 87.3 HRA, wear resistance of 0.93 $mm^{-3}$, and Palmquist toughness of 17.4 $MPa \cdot m^{1/2}$. Again referring to FIG. 7A, hybrid cemented carbide 70 also includes a dispersed phase 72 of a cemented carbide commercially available as Firth Sterling™ grade FK10F™ cemented carbide, which is a relatively hard cemented carbide with relatively high wear resistance. Grade FK10F™ cemented carbide includes 94 wt. % of tungsten carbide particles with an average grain size of approximately 0.8 μm as a discontinuous phase, and 6 wt. % of a cobalt binder. The properties of Firth Sterling™ grade FK10F™ cemented carbide include hardness of 93 HRA, wear resistance of 6.6 $mm^{-3}$, and Palmquist toughness of 9.5 $MPa \cdot m^{1/2}$.

The hybrid cemented carbide 70 was produced by blending 30 vol. % of unsintered or "green" granules of grade FK10F™ cemented carbide powder to form the dispersed phase, with 70 vol. % of unsintered or "green" granules of grade 2055™ cemented carbide powder to form the continuous phase. The blended cemented carbide powders formed a powder blend. A portion of the blend was consolidated, such as by compaction, to produce a green compact. The green compact was subsequently sintered using conventional means to further densify the material and fuse the powder particles together. The resultant hybrid cemented carbide 70 had a hard discontinuous phase contiguity ratio of 0.5 and a Palmquist toughness of 12.8 $MPa \cdot m^{1/2}$. As can be seen in FIG. 7A, the unsintered granules of the dispersed phases collapsed in the direction of the application of pressure during compaction of the powder blend, resulting in the formation of physical connections between previously unconnected domains of the powder grade that became the dispersed phase 72. Due to the connections that formed between the domains of the dispersed phase cemented carbide powder during consolidation, the hybrid cemented carbide produced by sintering hand a relatively high discontinuous phase contiguity ratio of approximately 0.5. Physical contact between the dispersed phase regions 70 in the material of FIG. 7A, for example, allows cracks beginning in one dispersed phase domain to more readily propagate by following a continuous path through the hard dispersed phase and without encountering the tougher continuous phase 71. Therefore, although the hybrid cemented carbide 70 may exhibit some improvement in toughness relative to certain conventional (i.e., non-hybrid) cemented carbides, the hybrid composite 70 will tend to have toughness closer to the hard dispersed phase 72 than to the tougher continuous phase 71.

A hybrid cemented carbide 75, shown in FIG. 7B, was prepared for use in earth-boring bit bodies, roller cones, mud nozzles, and other parts according to the present disclosure. Hybrid cemented carbide 75 includes a relatively tough and crack-resistant continuous cemented carbide phase 76, and a relatively hard and wear-resistant dispersed cemented carbide phase 77. The composition and the volume ratio of the two cemented carbide grades forming the dispersed and continuous phases of hybrid cemented carbide 75 was the same as the hybrid cemented carbide of FIG. 7A. However, the method of producing hybrid cemented carbide 75 differed from the method of producing hybrid cemented carbide 70, which resulted in differing composite microstructures and significantly different properties. Specifically, the cemented carbide powder that formed dispersed phase 77 was sintered prior to being combined with the cemented carbide powder that became continuous phase. The sintered granules that became the dispersed phase 77 did not collapse significantly upon consolidation of the powder blend, and this resulted in the much lower contiguity ratio of 0.31 for the dispersed phase of the hybrid cemented carbide 75. A reduced contiguity ratio may have a significant effect on the bulk properties of a hybrid cemented carbide. The hardness of hybrid cemented carbide 75 shown in FIG. 7B was measured as 15.2 $MPa \cdot m^{1/2}$, which was more than 18% greater than the hardness measured for hybrid cemented carbide 70 shown in FIG. 7A. The relative increased hardness of hybrid material 75 was believed to be a result of the lower frequency of interconnections between dispersed phase regions in the material. As such, it is more likely that a crack beginning in any of the hard dispersed phase regions 77 and propagating through hybrid material 75 will encounter the tougher continuous phase 76, which is more resistant to further propagation of the crack.

Non-limiting examples of powder blends for producing hybrid cemented carbides that may be used in articles according to the present disclosure are described below. It will be understood that necessarily only a limited number of possible powder blends are presented herein and that such blends are in no way exhaustive of the possible blends that may be used to produce hybrid cemented carbides useful in the present invention.

EXAMPLE 1

A powder blend that may be used to make a hybrid cemented carbide useful in the present invention is prepared by combining the following powder grades: 85% by weight of ATI Firth Sterling grade FL30 powder (forms continuous phase of hybrid cemented carbide) powder, and 15% by weight of ATI Firth Sterling grade HU6C powder (forms dispersed phase). The continuous phase powder grade (FL30 powder) is initially in the form of relatively spherical powder granules in the as-spray dried condition, which also referred to as the "green" powder condition. The dispersed phase powder grade (HU6C powder) is also initially in the as-spray dried condition, but the green granules are heat-treated (presintered) in a vacuum environment at about 800° C. prior to blending The green FL30 powder granules are blended with the presintered HU6C powder granules in a V-blender for about 45 minutes. The composition and properties of the two powders are listed in Table 1, wherein TRS is transverse rupture strength.

TABLE 1

| | Grade FL-30 Powder | Grade HU6C Powder |
|---|---|---|
| Composition | WC particles and Co + Ni binder | WC particles and Co binder |
| Hardness (HRA) | 79.0 | 92.7 |
| Binder Content (wt. %) | 30.0 (Co + Ni) | 6.0 (Co) |
| Density (g/cc) | 12.70 | 14.90 |
| TRS (ksi) | 320 | 500 |
| Average WC Grain Size (μm) | 3 to 5 | 0.8 |

EXAMPLE 2

An additional powder blend that may be used to make a hybrid cemented carbide useful in the present invention is prepared by combining the following powder grades: 80% by weight of ATI Firth Sterling grade FL25 powder (forms continuous phase), and 20% by weight of ATI Firth Sterling grade P40 powder (forms dispersed phase). The continuous phase powder grade (FL25 powder) is initially in the form of relatively spherical powder granules in the as-spray dried (green powder) condition. The dispersed phase powder grade (P40 powder) is also initially in the as-spray dried condition. The green FL25 powder granules are blended with the green HU6C powder granules in a double-cone blender for about 60 minutes. The composition and properties of the two powder grades are listed in Table 2.

TABLE 2

| | Grade FL-25 Powder | Grade P40 Powder |
|---|---|---|
| Composition | WC particles and Co + Ni binder | WC particles and Co binder |
| Hardness (HRA) | 81.0 | 91.2 |
| Binder Content (wt. %) | 25.0 (Co + Ni) | 6.0 (Co) |
| Density (g/cc) | 13.00 | 14.90 |
| TRS (ksi) | 350 | 475 |
| Average WC Grain Size (μm) | 3 to 5 | 1.5 |

EXAMPLE 3

Another powder blend that may be used to make a hybrid cemented carbide useful in the present invention is prepared by combining the following powder grades: 90% by weight of ATI Firth Sterling grade H20 powder (forms continuous phase), and 10% by weight of ATI Firth Sterling grade H17 powder (forms dispersed phase). The continuous phase powder grade (H20 powder) is initially in the form of relatively spherical powder granules in the as-spray dried (green powder) condition. The dispersed phase powder grade (H17 powder) is also initially in the as-spray dried condition, but the powder granules are heat-treated in a vacuum (presintered) at about 1000° C. prior to blending. The green H20 powder granules are blended with the presintered powder H17 granules in a V-blender for about 45 minutes. The composition and properties of the two powder grades are listed in Table 3.

TABLE 3

| | H20 | H17 |
|---|---|---|
| Composition | WC particles and Co binder | WC particles and Co binder |
| Hardness (HRA) | 84.5 | 91.7 |
| Binder Content (wt. %) | 20.0 (Co) | 10.0 (Co) |
| Density (g/cc) | 13.50 | 14.50 |
| TRS (ksi) | 400 | 550 |
| Average WC Grain Size (μm) | 3 to 5 | 0.8 |

EXAMPLE 4

Yet another powder blend that may be used to make a hybrid cemented carbide useful in the present invention is prepared by combining the following powder grades: 80% by weight of ATI Firth Sterling grade ND30 powder (forms continuous phase), 10% by weight of ATI Firth Sterling grade HU6C powder (forms first dispersed phase), and 10% by weight of ATI Firth Sterling grade AF63 powder (forms second dispersed phase). The continuous phase powder grade (ND30 powder) is initially in the form of relatively spherical powder granules in the as-spray dried, "green" condition. The dispersed powder grades (HU6C and AF63 powders) are also initially in the as-spray dried condition. The HU6C powder granules, however, are heat-treated in a vacuum (presintered) at about 800° C. prior to blending. The green ND30 powder granules are blended with the presintered HU6C and the green AF63 powder granules in a Turbula blender for about 30 minutes. The properties of the three powder grades are listed in Table 4.

TABLE 4

| | ND30 | HU6C | AF63 |
|---|---|---|---|
| Composition | WC particles and Co binder | WC particles and Co binder | WC particles and Co binder |
| Hardness (HRA) | 81.0 | 92.7 | 89.5 |
| Binder Content (wt. %) | 30.0 Co | 6.0 (Co) | 6.0 (Co) |
| Density (g/cc) | 12.7 | 14.90 | 14.90 |
| TRS (ksi) | 340 | 500 | 480 |
| Average WC Grain Size (μm) | 3 to 5 | 0.8 | 3 to 5 |

According to one aspect of the present disclosure, a method of making an earth-boring bit part includes providing a hybrid cemented carbide in the part wherein the hybrid material has a contiguity ratio that is less than 1.5 times the volume fraction of the dispersed phase in the hybrid material. In certain earth-boring bit bodies, roller cones, mud nozzles, and other related parts it may be advantageous to further limit the contiguity ratio of a hybrid cemented carbide included in the parts to less than 1.2 times the volume fraction of the dispersed phase within the hybrid cemented carbide. The contiguity ratio may be lowered, for example, by partially or fully presintering the cemented carbide powder to be included as the discontinuous phase. Alternatively, the contiguity ratio may be lowered by reducing the volume percentage of the dispersed cemented carbide phase within the hybrid material, with or without presintering the powder included in the powder mix as the dispersed phase prior to blending with the powder of the continuous cemented carbide phase to produce the powder blend.

Embodiments disclosed herein are directed to methods of producing hybrid cemented carbide composites having improved properties, and also are directed to earth-boring bit parts incorporating hybrid cemented carbides in at least a region or a portion of a region of the parts. One non-limiting method of producing hybrid cemented carbides useful in earth-boring bit parts includes blending a green, unsintered cemented carbide grade that forms the dispersed phase of the hybrid material with a green, unsintered cemented carbide grade that forms the continuous phase of the hybrid material. In another non-limiting embodiment, a method of producing a hybrid cemented carbide useful in earth-boring bit parts includes forming a powder blend by combining a quantity of at least one of partially and fully sintered granules of the cemented carbide grade that forms the dispersed phase of the hybrid material, with a quantity of at least one of green and unsintered granules of the cemented carbide grade that forms the continuous phase of the hybrid material. At least a portion of the powder blend is consolidated to form, a green compact, and the green compact is sintered using conventional sintering means. Partial or full sintering of the granules of the cemented carbide that is to from the dispersed phase results in strengthening of those granules (as compared with unsintered or "green" granules), and the strengthened granules will have improved resistance to collapse during consolidation of the powder blend, thereby reducing contiguity ratio in the final hybrid material. The granules of the dispersed phase may be partially or fully sintered at temperatures ranging from about 400° C. to about 1300° C., depending on the strength of the final dispersed phase desired in the hybrid cemented carbide. The cemented carbide powder granules may be sintered using any of a variety of means known in the art, such as, but not limited to, hydrogen sintering and vacuum sintering. Sintering of the granules may result in removal of lubricant, oxide reduction, densification, and microstructure development.

Embodiments of a method of producing hybrid cemented carbides for earth-boring bit parts that includes presintering of the cemented carbide powder granules that forms the discontinuous phase of the hybrid material allows for forming hybrid cemented carbides having relatively low dispersed phase contiguity ratios, such as the hybrid material illustrated in FIG. 7B. Because the granules of at least one cemented carbide are partially or fully presintered prior to combining with other powders to form the powder blend, the sintered granules are less likely to collapse during consolidation of the powder blend in the way shown in FIG. 7A and the contiguity of the resultant hybrid cemented carbide is relatively low. Generally speaking, the larger the dispersed phase cemented carbide granule size and the smaller the continuous cemented carbide phase granule size, the lower the contiguity ratio at any volume fraction of the hard discontinuous phase grade. Hybrid cemented carbide 75, for example, shown in FIG. 7B, was produced by first presintering the dispersed phase cemented carbide grade powder granules at about 1000° C.

In one non-limiting embodiment of a method for making an earth-boring bit part including a hybrid cemented carbide according to the present disclosure, a quantity of a first grade of cemented carbide powder is combined with a quantity of a second grade of cemented carbide power to provide a powder blend. As used herein a "grade" of cemented carbide powder refers to a cemented carbide powder having a particular hard metal carbide particle composition and size distribution, together with a particular binder composition and volume percentage. One having ordinary skill in the art recognizes that different grades of cemented carbide powders are used to impart desired levels of differing properties, such as hardness and toughness, to a sintered cemented carbide part. In one non-limiting embodiment of the method, the first grade of cemented carbide is partially or fully presintered prior to being combined with the second grade of cemented carbide powder to form the powder blend. At least a portion of the powder blend is consolidated, such as in the void of a suitably configured mold, to form a green compact of a desired configuration and size. Consolidation may be conducted using conventional techniques such as, for example, mechanical or hydraulic pressing in rigid dies, and wet-bag or dry-bag isostatic pressing techniques.

The green compact may be presintered or fully sintered to further consolidate and densify the powders. Presintering results occurs at a lower temperature than the temperature to be used in the final sintering operation and results in only partial consolidation and densification of the compact. The green compact may be presintered to provide a presintered or "brown" compact. A brown compact has relatively low hardness and strength as compared to the final fully sintered article, but has significantly higher strength and hardness than the green compact. During manufacturing, the green compact, brown compact, and/or fully sintered article may be machined to further modify the shape of the compact or article and provide the final earth-boring bit part. Typically, a green or brown compact is substantially easier to machine than the fully sintered article. Machining the green or brown compact may be advantageous if the fully sintered part is difficult to machine and/or would require grinding to meet the required final dimensional final tolerances. Other means to improve machinability of the green or brown compacts also may be employed such as, for example, addition of machining agents to the powder mix to close porosity within the compacts. One conventional machining agent is a polymer. In certain non-limiting embodiments, sintering may be conducted at liquid phase temperature in a conventional vacuum furnace or at high pressures in a SinterHIP-type furnace. For example, in one non-limiting embodiment of a method according to the present disclosure, the compact is over-pressure sintered at 300-2000 pounds per square inch (psi) and at 1350 to 1500° C. Pre-sintering and sintering of the compact removes lubricants, and results in oxide reduction, densification, and microstructure development. After sintering, the first grade of cemented carbide powder included in the powder blend forms a cemented carbide dispersed phase, and the second grade of cemented carbide powder forms a cemented carbide continuous phase in the resulting hybrid cemented carbide composite. As stated above, subsequent to sintering, the resulting part may be used as-sintered or may be further appropriately machined or grinded to form the final configuration of a bit body, roller cone, mud nozzle, or other earth-boring bit part including a hybrid cemented carbide.

Embodiments disclosed herein include a method of producing a earth-boring bit part, such as, but not limited to, a bit body, a roller cone, or a mud nozzle including at least two cemented carbides in different regions or in different portions of a single region. The two cemented carbides may have different properties or compositions. A non-limiting embodiment of a method for making such a part includes placing quantity of a first hybrid cemented carbide powder into a first region of a void of a mold, and placing a portion of a second hybrid cemented carbide powder into a second region of the void of the mold. The void of the mold has a desired shape, which may be the shape of the part or, alternatively, may have a suitable intermediate shape. In certain non-limiting embodiments of the method, the void of the mold may be segregated into the two or more regions by, for example, placing a physical partition, such as paper, wax, or a polymeric material, in the void of the mold to separate the regions. In another non-limiting embodiment the powders of the first and second hybrid cemented carbide may be place in separate sections of the mold with a physical partition, and thus be in contact. The first and second hybrid cemented carbide compositions may be chosen to provide, after consolidation and sintering, a hybrid cemented carbide composite having the desired properties for each region of an earth-boring bit part.

An earth-boring bit component with a gradient of a property or composition also may also be formed by, for example, placing a quantity of a first hybrid cemented carbide powder blend in a first region of a void of a mold. A second region of the mold void may be filled with a blend of the first hybrid cemented carbide powder a second hybrid cemented carbide powder blend. The blend of the two hybrid cemented carbide powder blends will result in a region having a property of a level intermediate that of a sintered material formed solely from the first hybrid cemented carbide powder and a sintered material formed solely from the second cemented carbide powder. This process may be repeated in separate regions of the mold void until the desired composition gradient or compositional structure is achieved, and typically would end with filling a region of the mold void with the second hybrid cemented carbide powder alone. Embodiments of this technique may also be performed with or without physical partitions in the mold void. The powders in the mold void may then be isostatically compressed to consolidate the different hybrid cemented carbide powder regions and form a green compact. The compact subsequently may be sintered to further densify the powders and form an autogenous bond between all of the regions established within the mold through addition of different blends.

Two non-limiting examples of methods of making earth-boring bit parts including hybrid cemented carbide according to the present disclosure follow. It will be understood that necessarily only a limited number of method examples are presented herein and are in no way exhaustive of the possible method embodiments that may be used to produce articles of manufacture according to the present disclosure.

EXAMPLE 5

Figure 2:
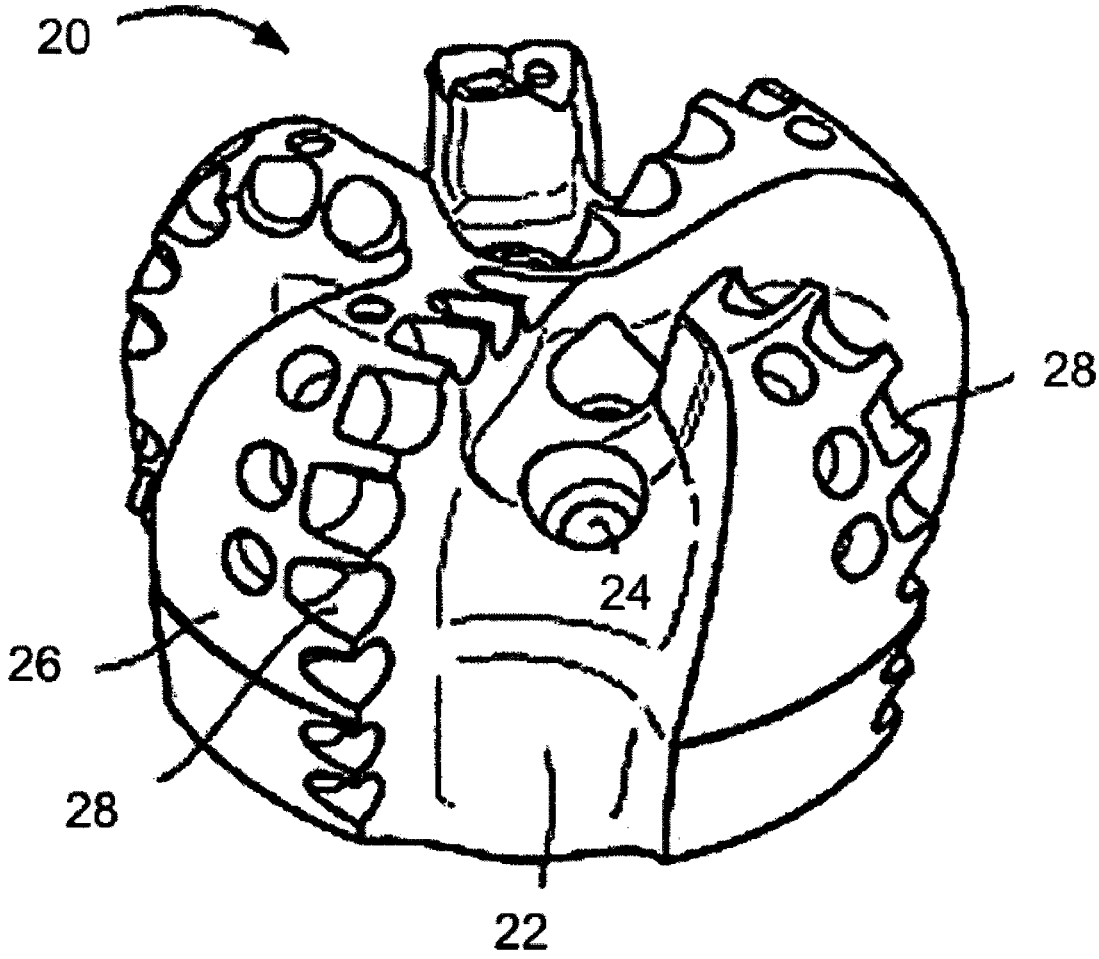
FIG. 2 (PRIOR ART)
FIG. 2 is a schematic perspective view of a conventional fixed-cutter earth-boring bit.

A fixed cutter earth-boring bit body based on a hybrid cemented carbide may be made as follows. A hybrid cemented carbide powder blend is prepared as described above in Example 1. At least a portion of the powder blend is consolidated by cold isostatic pressing at a pressing pressure of 25,000 psi to form a billet-shaped "green" powder compact. The compact is presintered in a hydrogen atmosphere at 700° C. The billet is machined using a five-axis milling machine to incorporate the conventional shape features of a finished fixed-cutter bit body, for example, as generally shown in FIG. 2. The machined pre-sintered part is sintered using over-pressure sintering (also referred to as "Sinter-HIP") at a temperature of 1380° C. and a pressure of 800 psi to produce the final bit body composed of hybrid cemented carbide.

EXAMPLE 6

A roller cone for a roller cone earth-boring bit based on a hybrid cemented carbide may be made as follows. A hybrid cemented carbide powder blend is prepared as described in Example 4 above. At least a portion of the powder blend is consolidated by cold isostatic pressing at a pressing pressure of 30,000 psi to form a billet-shaped "green" compact. The billet is presintered in a hydrogen atmosphere at 700° C. The billet is machined using a five-axis milling machine to incorporate the conventional shape features of a finished roller cone, for example, as generally shown in FIG. 1 as roller cone 14. The machined pre-sintered part is sintered using over-pressure sintering (SinterHIP) at a temperature of 1380° C. and a pressure of 800 psi to produce the final roller cone composed of hybrid cemented carbide.

It will be understood that the present description illustrates those aspects of the invention relevant to a clear understanding of the invention. Certain aspects that would be apparent to those of ordinary skill in the art and that, therefore, would not facilitate a better understanding of the invention have not been presented in order to simplify the present description. Although only a limited number of embodiments of the present invention are necessarily described herein, one of ordinary skill in the art will, upon considering the foregoing description, recognize that many modifications and variations of the invention may be employed. All such variations and modifications of the invention are intended to be covered by the foregoing description and the following claims.

I claim:

1. A roller cone earth-boring bit comprising:

a bit body consisting of hybrid cemented carbide composite;

a plurality of roller cones rotatably attached to the bit body; and at least one mud nozzle connected to the bit body;

wherein the hybrid cemented carbide composite comprises:

a cemented carbide dispersed phase comprising carbide particles sintered with a binder; and a cemented carbide continuous phase comprising carbide particles sintered with a binder;

wherein a physical property of the cemented carbide dispersed phase and the cemented carbide continuous phase differs.

2. The roller cone earth-boring bit of claim 1, wherein a contiguity ratio of the dispersed phase of the hybrid cemented carbide composite is no greater than 0.48.

3. The roller cone earth-boring bit of claim 1, wherein a contiguity ratio of the dispersed phase of the hybrid cemented carbide composite is less than 0.4.

4. The roller cone earth-boring bit of claim 1, wherein the contiguity ratio of the dispersed phase of the hybrid cemented carbide composite is less than 0.2.

5. The roller cone earth-boring bit of claim 1, wherein a hardness of the dispersed phase of the hybrid cemented carbide composite is greater than a hardness of the continuous phase of the hybrid cemented carbide composite.

6. The roller cone earth-boring bit of claim 1, wherein the hybrid cemented carbide composite comprises a first cemented carbide dispersed phase and a second cemented carbide dispersed phase, and wherein at least one of a composition and a physical property of the second cemented carbide dispersed phase differs from the first cemented carbide dispersed phase.

7. The roller cone earth-boring bit of claim 6, wherein the physical property is selected from the group consisting of hardness, Palmquist toughness, and wear resistance.

8. The roller cone earth-boring bit of claim 1, wherein the cemented carbide dispersed phase of the hybrid cemented carbide is between 2 and 50 percent by volume of the hybrid cemented carbide.

9. The roller cone earth-boring bit of claim 1, wherein the cemented carbide dispersed phase of the hybrid cemented carbide is between 2 and 25 percent by volume of the hybrid cemented carbide.

10. The roller cone earth-boring bit of claim 1, wherein the hardness of the cemented carbide dispersed phase of the hybrid cemented carbide is at least 88 HRA and no greater than 95 HRA.

11. The roller cone earth-boring bit of claim 10, wherein the Palmquist toughness of the cemented carbide continuous phase of the hybrid cemented carbide is greater than 10 $MPa \cdot m^{1/2}$.

12. The roller cone earth-boring bit of claim 10, wherein the hardness of the cemented carbide continuous phase of the hybrid cemented carbide is at least 78 HRA and no greater than 91 HRA.

13. The roller cone earth-boring bit of claim 1, wherein the cemented carbide dispersed phase and the cemented carbide continuous phase of the hybrid cemented carbide composite independently comprise:

at least one carbide of a metal selected from the group consisting of the metals of Groups IVB, VB, and VIB of the Periodic Table; and a binder comprising at least one of cobalt, a cobalt alloy, nickel, a nickel alloy, iron, and an iron alloy.

14. The roller cone earth-boring bit of claim 13, wherein the binder of at least one of the cemented carbide dispersed phase and the cemented carbide continuous phase of the hybrid cemented carbide further comprises an alloying agent selected from the group consisting of tungsten, titanium, tantalum, niobium, aluminum, chromium, copper, manganese, molybdenum, boron, carbon, silicon, and ruthenium.

15. The roller cone earth-boring bit of claim 14, wherein the alloying agent comprises up to 20 weight percent of the binder.

16. The roller cone earth-boring bit of claim 13, wherein a binder concentration of the dispersed phase is between 2 weight percent and 15 weight percent, and wherein a binder concentration of the continuous phase is between 6 weight percent and 30 weight percent.

17. The roller cone earth-boring bit of claim 13, wherein the cemented carbide dispersed phase and the cemented carbide continuous phase both comprise tungsten carbide and cobalt.

18. The roller cone earth-boring bit of claim 1, wherein a volume fraction of the dispersed phase is less than 50 volume percent of the hybrid cemented carbide composite.

19. The roller cone earth-boring bit of claim 1, wherein the cemented carbide dispersed phase has a contiguity ratio less than 1.5 times the volume fraction of the cemented carbide dispersed phase.

20. The roller cone earth-boring bit of claim 1, wherein the at least one mud nozzle is connected to a side surface of the bit body.

21. The roller cone earth-boring bit of claim 1, wherein the bit body has at least two distinct regions, the regions consisting of different hybrid cemented carbide composites.

22. The roller cone earth-boring bit of claim 1, further comprising a threaded attachment region connected to the bit body.

23. The roller cone earth-boring bit of claim 22, wherein the threaded attachment region comprises a hybrid cemented carbide composite.

24. A roller cone earth-boring bit comprising:

a bit body consisting of a hybrid cemented carbide composite;

a plurality of roller cones rotatably attached to the bit body, the roller cones comprising a hybrid cemented carbide composite; and at least one mud nozzle connected to the bit body;

wherein the hybrid cemented carbide composites each independently comprise:

a cemented carbide dispersed phase comprising carbide particles sintered with a binder; and a cemented carbide continuous phase comprising carbide particles sintered with a binder;

wherein a physical property of the cemented carbide dispersed phase and the cemented carbide continuous phase differs.

25. The roller cone earth-boring bit of claim 24, wherein the at least one mud nozzle is connected to a side surface of the bit body.

26. The roller cone earth-boring bit of claim 24, wherein the bit body has at least two distinct regions, the regions consisting of different hybrid cemented carbide composites.

27. A roller cone earth-boring bit comprising:

a bit body consisting of a hybrid cemented carbide composite;

a plurality of roller cones rotatably attached to the bit body; and at least one mud nozzle connected to the bit body, the at least one mud nozzle comprising a hybrid cemented carbide composite;

wherein the hybrid cemented carbide composites each independently comprise:

a cemented carbide dispersed phase comprising carbide particles sintered with a binder; and a cemented carbide continuous phase comprising carbide particles sintered with a binder;

wherein a physical property of the cemented carbide dispersed phase and the cemented carbide continuous phase differs.

28. The roller cone earth-boring bit of claim 27, wherein the at least one mud nozzle is connected to a side surface of the bit body.

29. The roller cone earth-boring bit of claim 27, wherein the bit body has at least two distinct regions, the regions consisting of different hybrid cemented carbide composites.

30. A roller cone earth-boring bit comprising:

a bit body consisting of a hybrid cemented carbide composite;

a plurality of roller cones rotatably attached to the bit body, the roller cones comprising a hybrid cemented carbide composite; and at least one mud nozzle connected to the bit body, the at least one mud nozzle comprising a hybrid cemented carbide composite;

wherein the hybrid cemented carbide composites each independently comprise:

a cemented carbide dispersed phase comprising carbide particles sintered with a binder; and a cemented carbide continuous phase comprising carbide particles sintered with a binder;

wherein a physical property of the cemented carbide dispersed phase and the cemented carbide continuous phase differs.

31. The roller cone earth-boring bit of claim 30, wherein the at least one mud nozzle is connected to a side surface of the bit body.

32. The roller cone earth-boring bit of claim 30, wherein the bit body has at least two distinct regions, the regions consisting of different hybrid cemented carbide composites.

* * * * *